US007018766B2

(12) United States Patent
Takano et al.

(10) Patent No.: US 7,018,766 B2
(45) Date of Patent: Mar. 28, 2006

(54) TONER AND PRODUCTION PROCESS THEREOF

(75) Inventors: Hidehiro Takano, Nagano (JP); Tahei Ishiwatari, Nagano (JP); Takuya Kadota, Nagano (JP); Rie Miyazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 193 days.

(21) Appl. No.: 10/702,081

(22) Filed: Nov. 6, 2003

(65) Prior Publication Data

US 2004/0143036 A1 Jul. 22, 2004

(30) Foreign Application Priority Data

Nov. 8, 2002 (JP) ..... P.2002-324779
Nov. 21, 2002 (JP) ..... P.2002-338561
Nov. 21, 2002 (JP) ..... P.2002-338565

(51) Int. Cl.
*G03G 9/00* (2006.01)

(52) U.S. Cl. ..... 430/111.1; 430/111.4; 430/108.1; 399/252

(58) Field of Classification Search ..... 430/111.1, 430/111.4, 108.1; 399/252
See application file for complete search history.

(56) References Cited

FOREIGN PATENT DOCUMENTS

| | | | |
|---|---|---|---|
| JP | 07-181733 | A | 7/1995 |
| JP | 2537503 | B2 | 7/1996 |
| JP | 09-015902 | A | 1/1997 |

*Primary Examiner*—Mark A. Chapman
(74) *Attorney, Agent, or Firm*—Sughrue Mion, PLLC

(57) ABSTRACT

The invention provides a toner comprising a binder resin, a colorant, and a charge control agent comprising a charge control substance supported by an inorganic porous material, and having been subjected to thermal fairing treatment. Also disclosed are a toner obtained by a process comprising the steps of: kneading a composition containing a binder resin, a colorant and a charge control agent comprising an ionic or neutral substance supported by an inorganic porous material; pulverizing the kneaded product; adding the pulverized product to a solvent immiscible with water; dispersing the mixture in an aqueous medium; and removing the solvent by at least one of heating and pressure reduction, and a toner comprising associated particles formed from: primary particles obtained from an emulsion of a binder resin; a colorant; and a charge control agent comprising a water soluble charge control substance incorporated in inorganic fine particles.

3 Claims, 1 Drawing Sheet

TONER AND PRODUCTION PROCESS THEREOF

FIELD OF THE INVENTION

The present invention relates to a toner to be used for electrophotography and electrostatic printing. More specifically, the invention, in a first aspect, relates to a toner for color image formation which is produced through conglobation treatment. In a second aspect, the invention relates to a toner for the color image formation which eliminates the need of a particle conglobation treatment by precipitating toner particles directly from a solution, and has excellent charge properties. In a third aspect, the invention relates to toner suitable for color image formation, which eliminates the need of a particle conglobation treatment by precipitating toner particles directly by the polymerization of a monomer component, and has excellent charge properties.

BACKGROUND OF THE INVENTION

In an image formation process such as electrophotography, a copy or print is formed by developing an electrostatic latent image formed on a photoreceptor having a photoconductive substance disposed thereon by using toner particles containing a colorant and then, fixing the toner image to a transfer material such as paper by heat or pressure.

In a color image forming apparatus, it is the common practice to adopt a process of developing an electrostatic latent image formed on a photoreceptor by using plural colors of toner, transferring the image to an intermediate transfer medium, and transferring and fixing the color image to paper or the like. This process is characterized by that only one photoreceptor is necessary for the formation of an electrostatic latent image a complex optical system is not required for the image formation, and an image can be transferred to any medium that cannot be wound around a cylindrical photoreceptor surface.

When an intermediate transfer medium is used, however, the toner is required to have a high transfer efficiency, because transfer is performed twice, that is, transfer from a photoreceptor to the intermediate transfer medium and transfer from the intermediate transfer medium to a recording medium. The toner which has remained untransferred becomes not only a waste toner but causes a phenomenon such as missing of characters or a portion of the image to be formed and deteriorates the quality of the image.

The transfer efficiency is influenced by various factors. Among them, it is considered that charge properties of a toner have a great influence.

It is the common practice to add a charge control agent in order to keep the charge properties of the toner stable. With a view to overcoming such a problem as easy generation of an oppositely charged toner upon friction charging owing to the irregularities on the surface of the toner, conglobation treatment of the toner for preventing charging defects due to undesirable toner surfaces is proposed (see, for example, Japanese Patent Application Laid-Open No. 181733/1995).

The conglobation treatment of a toner is carried out by heating the toner in the fluid form by hot air to soften its surface. In this step, however, the charge control agent existing in the vicinity of the surface of the toner is exposed to high temperatures and is therefore lost from the toner surface or suffers from quality deterioration through sublimation or oxidative decomposition, which makes the charge properties of the toner uneven and becomes one of the causes for transfer defects such as fog or opposite charge.

Further, of the various factors causing deterioration in the quality of the image formed by an image forming apparatus, the shape of a toner has a great influence. When the toner has irregularities on its surface and its shape is not uniform, the fluidity of the toner becomes insufficient even by the addition of a fluidity improving agent, leading to deterioration in developability, transfer properties and cleanability. Re-use of the toner in a developing step after recovery by cleaning tends to further deteriorate the image quality.

In order to improve fluidity or transfer properties of the toner, the toner surface is smoothened by decreasing the irregularities thereon.

As a method of decreasing the irregularities on the toner surface, it is known to conglobate the toner surface by mechanical or thermal fairing treatment as described above.

The mechanical or thermal fairing treatment is however accompanied with the above-described problem that a synthetic resin used as a binder may be conglobated insufficiently, or when exposed to high temperatures upon heat treatment, charge properties become uneven owing to the sublimation or oxidative decomposition of the charge control agent.

There is proposed a method of preparing a toner by precipitating, from a toner particle-forming composition, particles excellent in sphericity in a liquid without carrying out a thermal fairing step.

As one example, proposed is a toner preparation method called "solution dispersion method", which comprises mixing a binder resin and a colorant in a solvent immiscible with water, dispersing the mixture in an aqueous medium in the presence of a hydrophilic inorganic dispersing agent to prepare a suspension of particles, and then removing the solvent from the suspension by heating or pressure reduction (see, for example, Japanese Patent Laid-Open No. 15902/1997).

The solution dispersion method, however, involves such a problem that two solvents different in polarity are usually employed and because of the easy dissolution of the charge control agent, which exists in the vicinity of the liquid surface of the toner particles, in the solvent, and hence the effects of the charge control agent becomes insufficient.

Another problem of the above-described method is that as a result of sublimation or oxidative decomposition of the charge control agent in a drying step including heating or pressure reducing procedures after the removal of the solvent, the toner tends to be charged unevenly and cause transfer defects such as fog or opposite charge.

Separately, in order to overcome the above-described problems concerning the charging property unevenness, also proposed is a production process of a toner having an excellent sphericity, which comprises polymerizing monomer components of a binder resin in a liquid to prepare an emulsion of polymer particles having an acidic polar or basic polar group, mixing the emulsion with a colorant, a charge control agent, etc., heating and stirring the mixture to form associated particles of the toner (see, for example, Japanese Patent No. 2537503).

The above-described process is characterized by that a toner having an excellent sphericity can be prepared without any fairing treatment after the production of particles. However, this process is accompanied with such a drawback that among the charge control agent particles, those existing in the vicinity of the surface of the particles and having a great influence on the charge properties of the toner is readily eluted out into a solvent of the emulsion of the polymer.

In addition, for separating the toner particles thus prepared from a liquid, this process goes through a drying step by heating and/or pressure reduction. This drying step is, however, sometimes accompanied with sublimation or oxidative decomposition, which tends to disturb even charging of the toner and becomes a cause of transfer defects such as fog and reverse charge.

Although there may be considered, as a countermeasure, to preliminarily increase the concentration of the charge control agent for compensating the elution thereof into the liquid, but this cannot prevent the charging property from becoming uneven due to the adhesion of the eluted charge control agent onto the surface of the precipitated particles.

SUMMARY OF THE INVENTION

In a first aspect of the invention (hereinafter referred to as "first invention"), an object of the present invention is to provide a toner which does not undergo a change in the charge properties even exposed to high temperatures in the thermal fairing step and generates less fog or oppositely charged toner, in particular, a toner for use in a color image forming apparatus which transfers a toner image obtained by the development of an electrostatic latent image formed on a photoreceptor to an intermediate transfer medium and transfers the toner image from the intermediate transfer medium to a recording medium.

In a second aspect of the invention (hereinafter referred to as "second invention"), an object of the present invention is to provide a toner which is capable of preventing fog or charging defects owing to unevenness of the charge control agent of the toner particles, occurring when prepared by solidifying a toner forming composition and then precipitating particles directly by a solution dispersion method, and gives an image having excellent image quality, and gives a high transfer efficiency even when applied to a cleaner-less system in which an image is formed by simultaneous development and cleaning where a transfer toner residue is recovered from a photoreceptor to a developing roller by applying a bias voltage to the developing roller in the developing step and the recovered toner is used again upon subsequent developing step.

In a third aspect of the invention (hereinafter referred to as "third invention"), an object of the present invention is to provide a toner which comprises associated particles formed by mixing an emulsion of a binder-resin-constituting monomer with a colorant and a charge control agent, and which forms an image free from fog and transfer failure due to uneven charge properties caused by a loss of the charge control agent from the vicinity of the surface of the toner owing to elution of the charge control agent into a liquid in a toner particle formation step, or sublimation or oxidative decomposition in the drying step.

Another object of the third invention is to provide a toner having a high transfer efficiency even when applied to a cleaner-less system in which an image is formed by simultaneous development and cleaning where a transfer toner residue is recovered from a photoreceptor to a developing roller by applying a bias voltage to the developing roller in the developing step and the recovered toner is used again upon subsequent developing step.

Other objects and effects of the invention will become apparent from the following description.

The objects of the first invention have been achieved by providing a toner for use in an image forming apparatus which develops an electrostatic latent image formed on a photoreceptor, transfers the developed image onto a recording medium and then fixes the transferred image, said toner comprising a binder resin, a colorant, and a charge control agent supported by an inorganic porous material, and having been subjected to thermal fairing treatment.

As described above, the toner of the first invention uses a charge control agent supported by an inorganic porous material so that the charge control agent is stably held by the inorganic porous material. Even if the toner surface is subjected to thermal fairing treatment, loss of an ionic or neutral substance used as the charge control substance from the toner surface by the sublimation or oxidative decomposition can be decreased, by which a toner having excellent charge properties and having a surface subjected to thermal fairing treatment can be obtained.

The above-described toner is preferably used in an image forming apparatus which transfers a toner image obtained by the development of an electrostatic latent image formed on a photoreceptor to an intermediate transfer medium, transfers the toner image thereon to a recording medium and then fixes the transferred image thereto.

When the intermediate transfer medium is employed as described above, transfer must be conducted twice. Compared with the case where a toner image obtained by the development of an electrostatic latent image formed on a photoreceptor is transferred to a recording medium, the charge properties of the toner have therefore a greater influence on the image thus formed so that the thermal fairing treatment of the surface for improving the charge properties by bringing the surface shape to a sphere is indispensable. When the conventional charge control agent is used, lowering in the control function of the charge performance cannot be avoided, whereas the toner containing the charge control agent of the first invention provides a good image without causing deterioration in charge performance.

In the above-described toner, the thermal fairing treatment is preferably at least one of treatment by collision and hot-air conglobation treatment.

In addition, the above-described toner preferably has a ratio: $G(t)=G(t=0.01\ s)/G(t=ht)$ of 10 or less, wherein $G(t=0.01\ s)$ represents a relaxation modulus at a relaxation time t of 0.01 s and $G(t=ht)$ represents a relaxation modulus at a relaxation time t of ht that corresponds to a hot-air heating time (ht) during which toner particles are heated in a hot air in the hot-air treatment step, each determined by a dynamic viscoelasticity measurement of the toner particles.

As described above, the binder resin shows a small fluctuation in the relaxation modulus, so when the toner is heated upon the thermal fairing treatment, particularly, upon hot-air surface treatment, the shape of each toner particle approaches a true sphere owing to a great cohesion force inside of the toner particle and the conglobation thereof proceeds.

The above-described toner preferably contains, as the binder resin, a polymer having a urethane bond or urea bond in its main chain and being obtained by the polymerization of a compound having at least two isocyanate groups and an active hydrogen compound having at least two active-hydrogen-containing functional groups.

The toner made of such a urethane polymer has a great inner cohesion force.

In the above-described toner, the inorganic porous material preferably comprises at least one selected from the group consisting of silica gel, montmorillonite, bentonite, hectorite, kaolinite, serpentine, talc, pyrophyrite, feldspar, zeolite, wollastonite and sillimanite.

Since the inorganic porous material as described above is used as a carrier, the charge control substance is protected by the inorganic porous material against quality deterioration upon heat treatment.

The first invention also provides a process for producing a toner for use in an image forming apparatus which develops an electrostatic latent image formed on a photoreceptor, transfers the developed image onto a recording medium and then fixes the transferred image, which process comprises forming toner particles containing a binder resin, a colorant and a charge control agent supported by an inorganic porous material, and then subjecting the toner particles to thermal fairing treatment.

In the above-described production process, the thermal fairing treatment is preferably at least one of treatment by collision and hot-air conglobation treatment.

The objects of the second invention have been achieved by providing a toner for use in an image forming apparatus which develops an electrostatic latent image formed on a photoreceptor, transfers the developed image onto a recording medium and then fixes the transferred image, said toner being obtained by kneading a composition containing a binder resin, a colorant and a charge control agent comprising an ionic or neutral substance supported by an inorganic porous material, pulverizing the kneaded product, adding the pulverized product to a solvent immiscible with water, dispersing the mixture in an aqueous medium, and removing the solvent by at least one of heating and pressure reduction.

As described above, the toner of the second invention contains as a charge control agent having a charge control ionic or neutral substance supported on an inorganic porous material so that the charge control substance is stably supported by the inorganic porous material. Even if the charge control agent exists in the vicinity of the surface of the toner particles, it becomes possible to reduce a loss of the charge control ionic or neutral substance from the toner surface which will otherwise occur owing to sublimation or oxidation decomposition by heating or pressure reducing treatment, and to prevent the charge properties from becoming uneven. Thus, the toner having excellent charge properties can be obtained.

When a binder resin, a colorant and a charge control agent dissolved in a solvent immiscible with water are mixed directly in a solvent immiscible with water, addition of a dispersing agent is indispensable in order to prevent precipitation of the colorant and charge control agent.

When the dispersing agent is not used, it becomes difficult to uniformly knead the binder resin, colorant and charge control agent upon formation of a dispersion of the binder resin in a solvent immiscible with water. In addition, a portion of the pigment and charge control agent which have remained undispersed in the binder resin is precipitated in an aqueous system or forms particles containing excessive colorant or excessive charge control agent, resulting in the formation of a large amount of particles different in the composition from the desired toner particles. This causes uneven charging.

The dispersing agent is however usually equipped with both a lipophilic group and a hydrophilic group and these groups contained in the toner causes uneven charging. In addition, under highly humid environment, water tends to be adsorbed to a toner, causing a reduction in the charge amount. Hence, it is not preferred that the dispersing agent remains in the toner.

Accordingly, it is preferred to form toner particles by using a dispersion obtained by dispersing the binder resin, colorant and charge control agent without using a dispersing agent.

The toner of the second invention is obtained by kneading a mixture of a binder resin, a colorant and a charge control agent, pulverizing the kneaded product and then mixing the resulting particles with a solvent immiscible with water. It is therefore possible to form a more uniform composition irrespective of the solubility in a solvent, compared with the composition formed by mixing each of these components in a solvent immiscible with water.

The second invention also provides a developing unit in an image forming apparatus which develops an electrostatic latent image formed on a photoreceptor, transfers the image onto a recording medium, and then fixes the transferred image, said developing unit recovering, by a bias voltage applied to a developing roller, a toner which has been obtained by kneading a composition containing a binder resin, a colorant and a charge control agent comprising an ionic or neutral substance supported by an inorganic porous material, pulverizing the kneaded product, adding the pulverized product to a solvent immiscible with water, dispersing the mixture in an aqueous medium, and removing the solvent by at least one of heating and pressure reduction and has remained on the photoreceptor after the transfer.

The second invention further provides a process for producing a toner for use in an image forming apparatus which develops an electrostatic latent image formed on a photoreceptor, transfers the image onto a recording medium and then fixes the transferred image, which comprises kneading a composition containing a binder resin, a colorant and a charge control agent comprising an ionic or neutral substance supported by an inorganic porous material, pulverizing the kneaded product, adding the pulverized product to a solvent immiscible with water, dispersing the mixture in an aqueous medium, and removing the solvent by at least one of heating and pressure reduction.

The objects of the third invention have been achieved by providing a toner for use in an image forming apparatus which develops an electrostatic latent image formed on a photoreceptor, transfers the developed image onto a recording medium and then fixes the transferred image, said toner comprising associated particles formed of: primary particles obtained from an emulsion of a binder resin; a colorant; and a charge control agent comprising a water soluble charge control substance incorporated in inorganic fine particles.

The third invention also provides a process for producing a toner for use in an image forming apparatus which develops an electrostatic latent image formed on a photoreceptor, transfers the image onto a recording medium and then fixes the transferred image, which process comprises mixing an emulsion of a binder resin with a colorant and a charge control agent comprising a water soluble charge control substance incorporated in inorganic fine particles, forming associated particles by stirring and heating the resulting mixture, and separating a liquid by at least one of heating and pressure reduction.

As described above, the toner of the third invention is obtained by mixing, in a dispersion of primary particles comprising an emulsion of a binder resin, a colorant and a charge control agent comprising a water soluble charge control substance incorporated in inorganic fine particles, followed by stirring and heating. The toner has good charge properties, because an elution amount of the charge control agent in the aqueous medium of the emulsion is suppressed and also in a drying step by heating and/or pressure reduction, an amount of the charge control agent lost by sublimation or oxidative decomposition decreases.

The inorganic particles used in the toner for incorporating the water soluble charge control substance therein preferably comprises an inorganic porous material.

When the water soluble charge control substance is supported on the inorganic porous material, it is stably held in the pores of the inorganic porous material, making it possible to prevent a loss of the charge control agent during the production step of the toner particles or uneven distribution thereof on the surface of the toner.

The third invention also provides a developing unit in an image forming apparatus which develops an electrostatic latent image formed on a photoreceptor, transfers the image onto a recording medium, and then fixes the transferred image, said developing unit recovering, by a bias voltage applied to a developing roller, a toner remaining on the photoreceptor after the transfer, wherein said toner comprises associated particles formed of: primary particles obtained from an emulsion of a binder resin; a colorant; and a charge control agent comprising a water-soluble charge control substance incorporated in inorganic fine particles.

As described above, since the charge control agent stably exists on the surface of the toner, it has stable charge properties because the toner particles are nearly true spherical, and the amount of the toner remaining on the photoreceptor after the transfer is small, and the amount of the toner recovered in a developing unit by a developing roller to which a bias voltage has been applied is small. Therefore, the toner of the third invention is suitable for a cleaner-less developing unit.

DETAILED DESCRIPTION OF THE INVENTION

Figure 1:
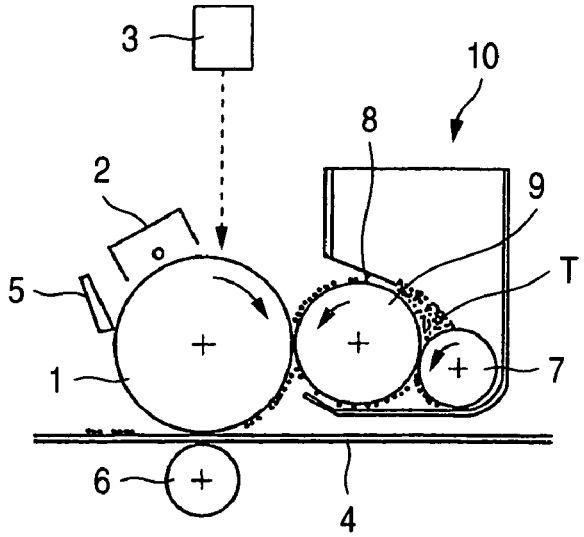
FIG. 1 illustrates an example of a contact development system image forming apparatus using the toner of the present invention.

Firstly, the toner of each of the first, second and third inventions will be described in more detail in this order.

First Invention

In the first invention, a charge control agent having a charge control substance supported on an inorganic porous material is used in a toner to be used in an image forming apparatus transferring a toner image, which has been obtained by the development of an electrostatic latent image on a photoreceptor, to a recording medium via an intermediate transfer medium and thereby forming a color image. Even after thermal fairing treatment such as hot-air conglobation treatment of the toner, stable existence of the charge control agent makes it possible to reduce fog or opposite charge of the toner and form a color image having excellent characteristics.

Silicate or silica, that is, inorganic fine particles to be used as a carrier of the charge control agent is effective for dispersing the charge control agent in the binder resin and charging the resin. The charge control substance exists in the pores formed on the surface of the particles and serves to control the charge. Since the charge control substance exists inside of the pores of the inorganic porous particles and adsorbed or protected thereby, sublimation and decomposition thereof can be suppressed.

Accordingly, even when conglobation treatment such as hot-air treatment or mechanical treatment is given to the toner particles obtained by kneading and pulverizing the toner in a closed system such as twin screw kneader, the charge control agent which exists on the surface of the toner particles and has a great influence on the charge properties of the toner exists stably and uniformly. This brings about effects of reducing fog and reverse transfer of the toner.

The charge control agent in the toner of the first invention has a feature that it has a charge control substance incorporated in an inorganic porous material.

Examples of the inorganic porous material include silica gel, montmorillonite, bentonite, hectorite, kaolinite, serpentine, talc, pyrophyrite feldspar, zeolite, wollastonite and sillimanite. At least one of them can be used as the inorganic porous material.

The inorganic porous material preferably has a number-average particle size of from 5 μm to 100 μm, more preferably from 30 μm to 70 μm.

When it is greater than 100 μm, the toner mother particles tend to form irregularities on their surfaces upon production, while when it is less than 5 μm, complete pores cannot be formed and the charge control substance cannot be supported therein. The number-average particle sizes outside the above-described range are therefore not preferred.

The pore size is preferably 0.5 nm to 10 nm. At a pore size less than 0.5 nm, it is difficult to support the charge control substance in the pores, while at a pore size greater than 10 nm, the charge control substance is apt to fall from the pore.

The charge control agent to be used in the first invention can be prepared by treating such an inorganic porous material with a solution containing a predetermined concentration of a charge control substance to have the charge transfer substance supported on the inorganic porous material. Examples of the charge control substance include "Oil Black", "Oil Black BY", and "BONTRON S-22 and S-34" (each, trade name, product of Orient Chemical Industries, Ltd.), "Salicylic Acid Metal Complex E-81 and E-84" (each, trade name; product of Orient Chemical Industries, Ltd.), thioindigo pigments, sulfonylamine derivatives of copper phthalocyanine, "Spiron Black TRH" (trade name; product of Hodogaya Chemical Industries, Ltd.), calixarene compounds, organic boron compounds, fluorine-containing quaternary ammonium salt compounds, monoazo metal complexes, aromatic hydroxycarboxylic acid metal complexes, aromatic dicarboxylic acid metal complexes and polysaccharides.

Although any toner mother particles obtained by the pulverization method or polymerization method are usable for the preparation of the toner containing the charge control agent according to the first invention, the latter is preferred in the full color image formation.

In the pulverization method, toner particles are prepared by incorporating at least a pigment in a resin binder, adding a releasing agent and a charge control agent to the mixture, uniformly mixing the resulting mixture in a Henschel mixer, melting and kneading the mixture in a twin-screw extruder, subjecting the kneaded product to crude-pulverization and fine pulverization after cooling, classifying the particles and then causing external additive particles to adhere thereto.

As the binder resin, synthetic resins used as a toner resin can be used. Examples include styrene resins which are homopolymers or copolymers containing styrene or substituted styrene such as polystyrene, poly-α-methylstyrene, chloropolystyrene, styrene-chlorostyrene copolymers, styrene-propylene copolymers, styrene-butadiene copolymers, styrene-(vinyl chloride) copolymers, styrene-(vinyl acetate) copolymers, styrene-(maleic acid) copolymers, styrene-acrylate copolymers, styrene-methacrylate copolymers, styrene-acrylate-methacrylate copolymers, styrene-(methyl-α-chloroacrylate) copolymers, styrene-acrylonitrile-acrylate copolymers and styrene-(vinyl methyl ether) copolymers, polyester resins, epoxy resins, urethane-modified epoxy resins, silicone-modified epoxy resins, polyvinyl chloride resins, rosin-modified maleic acid resins, phenyl resins, polyethylene, polypropylene, ionomer resins, polyurethane resins, silicone resins, ketone resins, ethylene-(ethyl acrylate) copolymers, xylene resins, polyvinyl butyral resins, terpene resins, phenolic resins, and aliphatic or alicyclic hydrocarbon resins. These binder resins may be used either singly or in combination.

Particularly in the first invention, toner particles having a urethane resin as the binder resin are preferred, of which those having, as the binder resin, a polymer having a urethane bond or urea bond in its main chain and obtained by the polymerization of a compound having at least two isocyanate groups and an active hydrogen compound having at least two active hydrogen functional groups are particularly preferred.

When the toner particles using a urethane resin having such a chemical structure are subjected to conglobation treatment in a hot air in a hot air conglobation apparatus, the toner shape can be brought close to a true sphere owing to a great cohesion force inside of the particles when the particles are softened.

A description will next be made of a urethane resin suitable for the toner of the first invention.

The suitable urethane resin contains, as a binding element, a urethane bond (—A—NHCOO—B—, in which A represents a polyisocyanate residue and B represents a compound residue having a plurality of active hydrogen groups) resulting from the reaction between a hydroxyl group and an isocyanate group; or a urea bond (—NHCOHN—) resulting from the reaction between an amino group and an isocyanate group.

Examples of the polyisocyanate include aliphatic diisocyanates such as ethane diisocyanate, propane diisocyanate, butene diisocyanate, butane diisocyanate, thiodiethyl diisocyanate, pentane diisocyanate, β-methylbutane diisocyanate, hexane diisocyanate, ω,ω'-dipropylether diisocyanate, thiodipropyl diisocyanate, heptane diisocyanate, 2,2-dimethylpentane diisocyanate, 3-methoxyhexane diisocyanate, octane diisocyanate, 2,2,4-trimethylpentane diisocyanate, nonane diisocyanate, decane diisoyanate, 3-butoxyhexane diisocyanate, 1,4-butyleneglycol dipropylether ω,ω'-diisocyanate, undecane diisocyanate, dodecane diisocyanate, and thiodihexyl diisocyanate.

Examples of the aliphatic diisocyanate having a cyclic group include ω,ω'-1,3-dimethylbenzene diisocyanate, ω,ω'-1,2-dimethylbenzene diisocyanate, ω,ω'-1,2-dimethylcyclohexane diisocyanate, ω,ω'-1,4-dimethylcyclohexane diisocyanate,ω,ω'-1,4-diethylbenzene diisocyanate,ω,ω'-1,4-dimethylnaphthalene diisocyanate, ω,ω'-1,5-dimethylnaphthalene diisocyanate, 3,5 -dimethylcyclohexane-1-methylisocyanato-2-propyl isocyanate, and ω,ω'-n-propylbiphenyl diisocyanate.

Examples of the aromatic diisocyanates include 1,3-phenylene diisocyanate, 1,4-phenylene diisocyanate, 1-methylbenzene-2,4-diisocyanate, 1-methylbenzene-2,5-diisocyanate, 1-methylbenzene-3,5-diisocyanate, 1,3-dimethylbenzene-2,4-diisocyanate, 1,3-dimethylbenzene-4,6-diisocyanate, 1,4-dimethylbenzene-2,5-diisocyanate, 1-ethylbenzene-2,4-diisocyanate, 1-isopropylbenzene-2,4-diisocyanate, diethylbenzene diisocyanate, and diisopropylbenzene diisocyanate.

Examples of the naphthalene diisocyanates include naphthalene-1,4-diisocyanate, naphthalene-1,5-diisocyanate, naphthalene-2,6-diisocyanate, naphthalene-2,7-diisocyanate, and 1,1'-dinaphtyl-2,2'-diisocyanate.

Examples of the biphenyl diisocyanates include biphenyl-2,4'-diisocyanate, biphenyl-4,4'-diisocyanate, 3,3'-dimethylbiphenyl-4,4'-diisocyanate, 3,3'-dimethoxybiphenyl-4,4'-diisocyanate, and 2-nitrobiphenyl-4,4'-diisocyanate.

Examples of the di- or tri-phenylmethane diisocyanates and di- or tri-phenylethane diisocyanates include diphenylmethane-4,4'-diisocyanate, 2,2'-dimethyldiphenylmethane-4,4'-diisocyanate, diphenyldimethylmethane-4,4'-diisocyanate, 2,5,2',5' -tetramethyldiphenylmethane-4,4'-diisocyanate, 3,3'-dimethoxydiphenylmethane-4,4'-diisocyanate, 4,4'-dimethoxybiphenyl-3,3'-diisocyanate, 4,4'-diethoxyphenylmethane-3,3'-diisocyanate, 2,2'-dimethyl-5,5'-dimethoxydiphenylmethane-4,4'-diisocyanate, 3,3-dichlorodiphenyldimethylmethane-4,4'-diisocyanate, benzophenone-3,3'-diisocyanate, α,β-diphenylethane-2,4-diisocyanate, 3-nitrotriphenylethane-4,4'-diisocyanate, and 4-nitrotriphenylmethane-4,4'-diisocyanate.

Examples of the triisocyanates include 1-methylbenzene-2,4,6-triisocyanate, 1,3,5-trimethylbenzene-2,4,6-triisocyanate, naphthalene-1,3,7-triisocyanate, biphenyl-1,3,7-triisocyanate, diphenylmethane-2,4,4'-triisocyanate, 3-methyldiphenylmethane-4,6,4'-triisocyanate, triphenylmethane-4,4',41"-triisocyanate, and diphenyl-4,4'-diisocyanatocarbamic chloride.

In the first invention, preferred examples include diisocyanates having an alicyclic or aromatic hydrocarbon such as diphenylmethane-4,4'-diisocyanate (MDI), isophorone diisocyanate (IPDI), norbornane diisocyanate (NBDI), dicyclohexylmethane-4,4'-diisocyanate (hydrogenated MDI), p-xylylene diisocyanate, m-xylylene diisocyanate (XDI), p-phenylene diisocyanate, p-tetramethylxylylene diisocyanate, m-tetramethylxylylene diisocyanate, 1,5-naphthalene diisocyanate, triphenylmethane triisocyanate, 1,3-bis(isocyanatomethyl)cyclohexane (hydroqenated XDI), and 2,4-tolylene diisocyanate (TDI). Mixtures of two or more of these polyisocyanates are preferably used.

Examples of the active hydrogen compound having a plurality of active hydrogen groups include polyols and polyamines.

Examples of the polyols include hydrogenated bisphenol A, ethylene oxide adduct of bisphenol A, propylene oxide adduct of bisphenol A, polyethylene glycol, polypropylene glycol, polytetramethylene glycol, poly(caprolactone polyol) and poly(hexamethylene carbonate). Of these, adducts of bisphenol A with 2 to 6 moles of ethylene oxide and adducts of bisphenol A with 2 to 4 moles of propylene oxide are particularly preferred. These polyols have a hydroxyl value of from 100 to 350 mg·KOH/g, preferably from 200 to 290 mg·KOH/g.

As the polyamines, diamines such as hexamethylenediamine, 1,7-diaminoheptane, 1,8-diaminooctane, 1,9-diaminononane, o-phenylenediamine and m-phenylenediamine can be given by way of example.

The urethane resin usable in the first invention has a number average molecular weight (Mn) of from 1,500 to 20,000 and its properties greatly depend on the chemical structures of its constituents, that is, polyisocyanate and active hydrogen compound having a plurality of active hydrogen groups. For the preparation of the urethane resin, use of a mixture of several polyisocyanates or a mixture of several active hydrogen compounds having a plurality of active hydrogen groups is recommended. Preferred examples include a mixture of an alicyclic polyisocyanate and an aromatic polyisocyanate and a mixture of an ethylene oxide adduct of bisphenol A and a propylene oxide adduct of bisphenol A.

The polyisocyanate and the active hydrogen compound having a plurality of active hydrogen groups are preferably reacted at a ratio (NCO:active hydrogen) of the number of the isocyanate groups of the polyisocyanate to the number of the active hydrogen groups of the active hydrogen compound falling within a range of from 0.5 to 1.0, preferably from 0.7 to 1.0.

Upon preparation of the urethane resin, it is preferred to pour, at once or in portions, the polyisocyanate in the active hydrogen compound having a plurality of active hydrogen groups at a temperature of from 30 to 180° C., preferably from 30 to 140° C. under atmospheric pressure in a solventless manner and subjecting the mixture to bulk polymerization for several minutes to several hours.

Examples of the catalyst include dibutyltin dichloride, dimethyltin dichloride, tin octylate and triphenylammonium dichloride.

In the first invention, the urethane resin can be prepared by bulk polymerization in a container. This method does not need a step of removing a solvent or removing water produced as a byproduct as in the solution polymerization or polycondensation reaction. When the reaction is conducted in a solventless manner, continuous production can be conducted efficiently and the polymerization reaction can be carried out using a kneading means having a screw therein. It is recommended to react the active hydrogen compound having a plurality of active hydrogen groups with a polyisocyanate by successively adding the latter to the former and kneading. Kneading is conducted preferably by an extruder, particularly preferably by a twin screw kneader.

The urethane resin usable in the first invention has a number average molecular weight (Mn), in terms of polystyrene, of from 1,500 to 20,000, preferably 2,000 to 10,000, still more preferably from 3,000 to 8,000.

Its weight-average molecular weight (Mw) is from 3,000 to 300,000, preferably from 5,000 to 50,000, more preferably from 8,000 to 20,000, while its Mw/Mn is from 1.5 to 2.0, preferably from 1.5 to 10, more preferably from 1.5 to 5. The Mw/Mn exceeding 20 widens the softening point range, leading to deteriorated color reproduction upon color mixing and deteriorated transparency of an OHP image.

The number average molecular weight (Mn) of the urethane resin of the first invention can be adjusted within a range of from 1,500 to 20,000 by controlling the number of the moles of the polyisocyanate to be reacted. The molecular weight can be lowered by decreasing a ratio (active hydrogen/NCO) of the number of active hydrogen groups in the active hydrogen compound having a plurality of active hydrogen groups to the number of isocyanate groups in the polyisocyanate. When the ratio approximates an equimolar amount, the urethane resin is able to have a high molecular weight.

A chain extender may be added as needed within an extent not having an influence on the physical properties of the urethane resin of the first invention. Examples of the chain extender include ethylene glycol, propylene glycol, 1,4-butanediol, bis-(β-hydroxy)benzene, and trimethylolpropane.

When a number average molecular weight (Mn) is less than 1500, the resulting urethane resin is poor in retention of a colorant, filming resistance, offset resistance, strength of a fixed image and storage stability, though having excellent low-temperature fixation. When it exceeds 20,000, on the other hand, the resulting urethane resin is poor in low temperature fixation and it cannot be used alone as a binder resin.

The urethane resin of the first invention has a flow softening point (Tm) of from 90 to 140° C., preferably from 100 to 130° C., while it has a glass transition point (Tg) of from 55 to 90° C., preferably from 55 to 80° C.

The urethane resin of the first invention is a highly crystalline polymer with a great intermolecular binding force so that lowering in Tg can be suppressed upon molecular designing for decreasing a molecular weight and thereby lowering Tm. It is therefore possible to attain both low Tm and high Tg.

Owing to its urethane bond or urea bond, the urethane resin of the first invention is excellent in both cohesion upon hot melting and high temperature offset resistance, can be made suitable as a toner for oil less fixation by adjusting its melt viscosity at a 50% efflux point of from $3\times10^3$ to $1.5\times10^4$ Pa·s, and at the same time, has resistance against mechanical stress or temperature in a developing unit, and is able to have both durability and storage stability which a toner is required to have. Thus, both low temperature fixation and storage stability can be attained.

To the urethane resin of the first invention, "other binder resin" may be added within an extent not impairing the properties of the urethane resin. The "other binder resin" may be added upon preparation of the urethane resin or may be kneaded into the resin prepared. When the "other binder resin is added upon preparation of the urethane resin of the first invention, a resin free of active hydrogen reactive with the polyisocyanate is preferred.

Examples of the "other binder resin" include styrene resins which are homopolymers or copolymers containing styrene or substituted styrene such as polystyrene, poly-α-methylstyrene, polychlorostyrene, styrene-chlorostyrene copolymer, styrene-propylene copolymer, styrene-butadiene copolymer, styrene-(vinyl chloride) copolymer, styrene-(vinyl acetate) copolymer, styrene-(maleic acid) copolymer, styrene-acrylate copolymer, styrene-methacrylate copolymer, styrelen-acrylate-methacrylate copolymer, styrene-(methyl-α-chloroacrylate) copolymer and styrene-acrylonitrile-acrylate copolymer, polyester resins, epoxy resins, urethane-modified epoxy resins, silicone-modified epoxy resins, polyvinyl chloride resins, rosin-modified maleic acid resins, phenyl resins, polyethylene, polypropylene, ionomer resins, polyurethane resins, silicone resins, ketone resins, ethylene-ethyl acrylate copolymers, xylene resins, polyvinyl butyral resins, terpene resins, phenolic resins and aliphatic or alicyclic hydrocarbon resins. They may be used either singly or in combination.

It has been found that in the conglobation treatment of toner particles, not only surface tension of the toner particles but also the strength of the inside cohesion force of the toner particles themselves have a great influence on the conglobation of the toner particles softened by hot air. Such cohesion force can be expressed by a relaxation modulus in a predetermined relaxation time as determined by the measurement of dynamic viscoelasticity. When having a ratio: G(t)=G(t=0.01 s)/G(t=ht) of 10 or less, wherein G(t=0.01 s) represents a relaxation modulus at a relaxation time t of 0.01 s and G(t=ht) represents a relaxation modulus at a relaxation time t of ht that corresponds to a hot-air heating time (ht) during which toner particles are heated in a hot air in the hot-air treatment step, each determined by a dynamic viscoelasticity measurement of the toner particles, the shape of each toner particle thus obtained approximates a true sphere.

The ratio G(t) of a relaxation modulus is more preferably from 2 to 7.

As the colorant for the toner of the first invention, colorants for toner can be used. Examples of dyes or pigments usable here include carbon black, lamp black, magnetite, titanium black, chrome yellow, ultramarine blue, aniline blue, phthalocyanine blue, phthalocyanine green, Hanza yellow G, Rhodamine 6G, Chalcoil Blue, quinacrdone, Benzidine Yellow, Rose Bengale, Malachite Green lake, Quinoline Yellow, C.I. Pigment Red 48:1, C.I. Pigment Red 122, C.I. Pigment Red 57:1, C.I. Pigment Red 184, C.I. Pigment Yellow 12, C.I. Pigment Yellow 17, C.I. Pigment Yellow 97, C.I. Pigment Yellow 180, C.I. Solvent Yellow 162, C.I. Pigment Blue 5:1 and C.I. Pigment Blue 15:3. They may be used either singly or in combination.

As the releasing agent, releasing agents for toner can be used. Examples include paraffin wax, micro wax, microcrystalline wax, candellila wax, carnauba wax, rice wax, montan wax, polyethylene wax, polypropylene wax, oxidative polyethylene wax, and oxidative polypropylene wax. Of these, polyethylene wax, polypropylene wax, carnauba wax and ester wax are preferred.

As for the component ratios in pulverization method toner, to 100 parts by weight of the binder resin, the colorant is added in an amount of from 0.5 to 15 parts by weight, preferably from 1 to 10 parts by weight, the releasing agent is added in an amount of from 1 to 10 parts by weight, preferably from 2.5 to 8 parts by weight, and the charge control agent is added in an amount of from 0.1 to 7 parts by weight, preferably from 0.5 to 5 parts by weight.

Examples of the polymerization method employed for the preparation of the toner include suspension polymerization, emulsion polymerization and dispersion polymerization. In the suspension polymerization, a monomer composition, which has been obtained by dissolving or dispersing a mixture of a polymerizable monomer, a coloring pigment and a releasing agent and optionally, a dye, a polymerization initiator, a crosslinking agent, a charge control agent and another additive, is added to an aqueous phase containing a suspension stabilizer (water soluble polymer, water insoluble inorganic substance) while stirring and then, the resulting mixture is pulverized and polymerized into colored polymerized toner particles having a desired particle size.

In the emulsion polymerization, a monomer and a releasing agent and optionally, a polymerization initiator and an emulsifier (surfactant) are dispersed in water to effect polymerization and in the subsequent cohesion procedure, a colorant, a charge control agent and a coagulant (electrolyte) are added, whereby colored toner particles having a desired particle size can be formed.

Among the materials for use in the preparation of toner particles by polymerization, the colorant, releasing agent and charge control agent are similar to those used for the preparation of the toner particles by the pulverization method.

As the polymerizable monomer, known vinyl monomers are usable. Examples include styrene, o-methylstyrene, m-methylstyrene, p-methylstyrene, α-methylstyrene, p-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethylhexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethylhexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propylene, acrylonitrile, methacrylonitrile, vinyl methyl ether, vinyl ethyl ether, vinyl ketone, vinyl hexyl ketone, and vinyl naphthalene. Examples of fluorine-containing monomers are 2,2,2-tritluoroethylacrylate, 2,2,3,3-tetrafluoropropylacrylate, vinylidene fluoride, ethylene trifluoride, tetrafluoroethylene, and trifluoropropyrene. They can be used because the fluorine atoms are effective for negative charge control.

Examples of the emulsifier include sodium dodecylbenzenesulfate, sodium tetradecylsulfate, sodium pentadecylsulfate, sodium octylsulfate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, polyoxyethylene dodecyl ether, polyoxyethylene hexadecyl ether, polyoxyethylene lauryl ether, and polyoxyethylene sorbitan monooleate ether.

Examples of the polymerization initiators include potassium persulfate, sodium persulfate, ammonium persulfate, hydrogen peroxide, 4,4'-azobis-cyanovaleric acid, t-butyl hydroperoxide, benzoyl peroxide, and 2,2'-azobis-isobutyronitrile.

Examples of the coagulant include electrolytes such as sodium chloride, potassium chloride, lithium chloride, magnesium chloride, calcium chloride, sodium sulfate, potassium sulfate, lithium chloride, magnesium sulfate, calcium sulfate, zinc sulfate, aluminum sulfate, and iron sulfate.

With regard to a sphericity adjusting method of the toner particles prepared by the polymerization, the sphericity can be changed freely by controlling the temperature and time during the coagulation procedure of the secondary particles in the emulsion polymerization. The sphericity which can be attained by this method falls within a range of from 0.94 to 1.00. In the suspension polymerization, toner particles of a true sphere can be prepared and its sphericity falls within a range of from 0.98 to 1.00. The sphericity can be adjusted freely even within a range of from 0.94 to 0.98 by heating and deforming the toner particles at a temperature equal to or greater than its Tg.

The number-average particle size of the toner is preferably 9 μm or less, more preferably from 8 μm to 4.5 μm. When a toner having the number average particle size exceeding 9 μm is used, reproducibility of the resolution becomes inferior to that of the toner having a smaller particle size even if a latent image is formed at resolution as high as 1200 dpi or greater. When it is less than 4.5 μm, coverage by the toner lowers and amount of an external additive must be raised to heighten the fluidity, resulting in the lowering tendency of the fixing performance. The number-average particle size outside the above-described range is therefore not preferred.

As an external additive for improving fluidity, silica particles are preferably added to the toner of the first invention.

As the silica particles, either of the particles prepared by the dry method using a silicon halide, etc. or the particles prepared by the wet method which are precipitated from a silicon compound in a liquid can be used.

The average particle size of the primary particles of the silica particles is preferably adjusted to fall within a range of from 7 nm to 40 nm, more preferably from 10 nm to 30 nm. When the primary particles of the silica particles have an average particle size less than 7 nm, they tend to be buried in the toner mother particles and charged negatively. When it exceeds 40 nm, the effect of the particles to impart fluidity to the toner mother particles lowers, making it difficult to uniformly charge the toner negatively. This results in an increasing tendency of the amount of the positively charged toner, that is, oppositely charged toner.

In the first invention, as the silica particles, a mixture of silica particles different in the number-average particle size distribution is preferred. Incorporation of an external additive having a greater particle size prevents it from being buried in the toner particles, while incorporation of silica particles having a smaller diameter imparts the toner particles with desirable fluidity.

More specifically, use of two kinds of silica particles, one having a number average primary particle size of from 5 nm to 20 nm, more preferably from 7 to 16 nm and the other one having a number average primary particle size of from 30 nm to 50 nm, more preferably from 30 nm to 40 nm is preferred.

The particle size of the external additive in the first invention is measured by electron microscopic observation and the number-average particle size is designated as the average particle size.

The silica particles to be used as the external additive in the first invention are preferably subjected to hydrophobic treatment with a silane coupling agent, titanium coupling agent, higher fatty acid, or silicone oil. Examples of the agent for use in hydrophobic treatment include dimethyldichlorosilane, octyltrimethoxysilane, hexamethyldisilazane, silicone oil, octyl-trichlorosilane, decyl-trichlorosilane, nonyl-trichlorosilane, (4-iso-propylphenyl)-trichlorosilane, (4-t-butylphenyl)-trichlorosilane, dipentyl-dichlorosilane, dihexyl-dichlorosilane, dioctyl-dichlorosilane, dinonyl-diochlorosilane, didecyl-dichlorosilane, didecyl-dichlorosilane, (4-t-butylphenyl)-octyl-dichlorosilane, didecenyl-dichlorosilane, dinonenyl-dichlorosilane, di-2-etylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosialne, and (4-isopropylphenyl)-diethyl-chlorosilane.

The hydrophobic treatment is effected by covering 100 parts by weight of the silica particles with 1 to 30 parts by weight of a hydroxide or oxide of the above-described substance, covering the resulting slurry with 3 to 50 parts by weight, based on the solid content of the slurry, of an alkoxysilane, neutralizing with an alkali, followed by filtration, washing, drying and pulverization.

In the first invention, the external additive is preferably added in an amount of from 0.05 to 2 parts by weight based on 100 parts by weight of the toner mother particles.

When the amount is less than 0.05 part by weight, the external additive cannot bring about fluidity imparting effects and excessive charge preventive effects. Amounts exceeding 2 parts by weight, on the other hand, lower the negative charge amount and increase the amount of a positively charged toner, resulting in an increase in fog or reverse transfer toner amount.

The toner of the first invention features its spherical shape attained by thermal fairing treatment. By this conglobation treatment for bringing the shape of the toner close to a true sphere, the toner has improved charge properties and transfer properties.

The thermal fairing treatment can be effected by using a collision type treatment apparatus and causing collision between toner particles or between toner particles and the wall of the treatment apparatus. In addition to the mechanical treatment on the surface, heat generated upon collision serves for fairing. Alternatively, during a procedure of causing the toner particles to flow in the hot air, they are softened and then conglobated by making use of their properties to become sphere by surface tension.

Examples of the collision type treatment apparatus include "Hybridizer NHS-1" (trade name; product of Nara Machinery Co., Ltd.), "Cosmos system" (trade name; product of Kawasaki Heavy Industries, Ltd.), "Mechanofusion" (trade name; product of Hosokawa Micron Corporation", and "MechanoMill" (trade name; product of Okada Seiko Co., Ltd.).

For the conglobation treatment by hot air, a hot air conglobation apparatus ("Surfusing system SFS-3", trade name; product of Nippon Pneumatic Mfg. Co., Ltd.) can be used. Toner particles can be brought close to a true sphere by adjusting the temperature and flow rate of the hot air, depending on the properties of the toner particles to be treated.

Particularly in the case of toner particles prepared by the pulverization method and having therefore large irregularities on the surface, the hot-air conglobation treatment may be preceded by fairing treatment by collision between toner particles or between toner particles and wall surface of a collision type pulverization apparatus.

Second Invention

In the second invention, the toner to be used for an apparatus which forms a color image by transferring a toner image obtained by development of an electrostatic latent image on a photoreceptor to a recording medium via an intermediate transfer medium is prepared by kneading a composition containing a binder resin, a colorant and a charge control agent, pulverizing the kneaded product, mixing the resulting particles in a solvent immiscible with water, dispersing the mixture in an aqueous medium, and removing the solvent by at least one of heating and pressure reduction. As the charge control agent for the toner, a charge-control ionic or neutral substance supported by an inorganic porous material is used. The charge control substance is stably supported in the inorganic porous material so that upon pulverization of the dispersion in an aqueous medium or upon removal of the solvent by at least one of heating and pressure reduction, the toner has stable charge properties and free from the generation of fog-causing toner or oppositely charged toner.

Accordingly, it is possible to provide a cleaner-less image forming apparatus which generates less transfer toner residue, suffers from less quality deterioration of the recovered toner and therefore has excellent properties, because the charge control agent exists stably and in turn, the toner has stable charge properties even when the toner of the second invention is applied to a cleaner-less image forming apparatus in which a developing drum recovers the transfer toner residue upon development of an electrostatic latent image formed on a photoreceptor.

Silicate or silica, that is, inorganic fine particles to be used as a carrier of the charge control agent is effective for dispersing the charge control agent in the binder resin and charging the resin. The charge control substance exists in the pores formed on the surface of the particles and serves to control the charge. Since the charge control substance exists inside of the pores of the inorganic porous particles and adsorbed or protected thereby, sublimation and decomposition thereof upon heating or pressure reduction in the manufacturing step can be suppressed.

The toner, which has been prepared by kneading a composition in a closed system such as twin screw kneader, pulverizing the kneaded product, mixing the resulting particles in a solvent immiscible with water, dispersing the mixture in an aqueous medium and removing the solvent by at least one of heating and pressure reduction, has, as the charge control agent, an ionic or neutral substance supported in an inorganic porous material so that upon pulverization of the dispersion in an aqueous medium or subsequent solvent removal step by heating or pressure reduction, sublimation or oxidative decomposition of the charge control agent can be prevented. Advantages such as decrease in fog and reduction in reverse transfer of the toner are brought by stable and uniform existence of the charge control agent.

The charge control agent in the toner of the second invention has a feature that it has a charge control substance incorporated in an inorganic porous material.

Examples of the inorganic porous material include silica gel, montmorillonite, bentonite, hectorite, kaolinite, serpentine, talc, pyrophyrite feldspar, zeolite, wollastonite and sillimanite. At least one of them can be used as the inorganic porous material.

The inorganic porous material preferably has a number-average particle size of from 5 μm to 100 μm, more preferably from 30 μm to 70 μm.

When it is greater than 100 μm, the toner mother particles tend to form irregularities on their surfaces upon production, while when it is less than 5 μm, complete pores cannot be formed and the charge control substance cannot be supported therein. The number-average particle sizes outside the above-described range are therefore not preferred.

The pore size is preferably 0.5 nm to 10 nm. At a pore size less than 0.5 nm, it is difficult to support the charge control substance in the pores, while at a pore size greater than 10 nm, the charge control substance is apt to fall from the pore.

The charge control agent to be used in the second invention can be prepared by treating such an inorganic porous material with a solution containing a predetermined concentration of a charge control substance to have the charge transfer substance supported on the inorganic porous material. Examples of the charge control substance include "Oil Black", "Oil Black BY", and "BONTRON S-22 and S-34" (each, trade name, product of Orient Chemical Industries, Ltd.), "Salicylic Acid Metal Complex E-81 and E-84" (each, trade name; product of Orient Chemical Industries, Ltd.), thioindigo pigments, sulfonylamine derivatives of copper phthalocyanine, "Spiron Black TRH" (trade name; product of Hodogaya Chemical Industries, Ltd.), calixarene compounds, organic boron compounds, fluorine-containing quaternary ammonium salt compounds, monoazo metal complexes, aromatic hydroxycarboxylic acid metal complexes, aromatic dicarboxylic acid metal complexes and polysaccharides.

As the binder resin, synthetic resins used as a toner resin can be used. Examples include styrene resins which are homopolymers or copolymers containing styrene or substituted styrene such as polystyrene, poly-α-methylstyrene, chloropolystyrene, styrene-chlorostyrene copolymers, styrene-propylene copolymers, styrene-butadiene copolymers, styrene-(vinyl chloride) copolymers, styrene-(vinyl acetate) copolymers, styrene-(maleic acid) copolymers, styrene-acrylate copolymers, styrene-methacrylate copolymers, styrene-acrylate-methacrylate copolymers, styrene-(methyl-α-chloroacrylate) copolymers, styrene-acrylonitrile-acrylate copolymers and styrene-(vinyl methyl ether) copolymers, polyester resins, epoxy resins, urethane-modified epoxy resins, silicone-modified epoxy resins, polyvinyl chloride resins, rosin-modified maleic acid resins, phenyl resins, polyethylene, polypropylene, ionomer resins, polyurethane resins, silicone resins, ketone resins, ethylene-(ethyl acrylate) copolymers, xylene resins, polyvinyl butyral resins, terpene resins, phenolic resins, and aliphatic or alicyclic hydrocarbon resins. These binder resins may be used either singly or in combination.

The urethane resins usable in the second invention have a urethane bond or urea bond and are available by bulk polymerization of a polyisocyanate and a compound having a plurality of active hydrogens. Examples of the polyisocyanate include aliphatic diisocyanates such as ethane diisocyanate, propane diisocyanate, butene diisocyanate, butane diisocyanate, thiodiethyl diisocyanate, pentane diisocyanate, β-methylbutane diisocyanate, hexane diisocyanate, ω,ω'-dipropylether diisocyanate, thiodipropyl diisocyanate, heptane diisocyanate, 2,2-dimethylpentane diisocyanate, 3-methoxyhexane diisocyanate, octane diisocyanate, 2,2,4-trimethylpentane diisocyanate, nonane diisocyanate, decane diisoyanate, 3-butoxyhexane diisocyanate, 1,4-butyleneglycol dipropylether ω,ω'-diisocyanate, undecane diisocyanate, dodecane diisocyanate, and thiodihexyl diisocyanate.

Examples of the aliphatic diisocyanate having a cyclic group include ω,ω'-1,3-dimethylbenzene diisocyanate, ω,ω'-1,2-dimethylbenzene diisocyanate, ω,ω'-1,2-dimethylcyclohexane diisocyanate, ω,ω'-1,4-dimethylcyclohexan diisocyanate, ω,ω'-1,4-diethylbenzene diisocyanate, ω,ω'-1,4-dimethylnaphthalene diisocyanate, ω,ω'-1,5-dimethylnaphthalene diisocyanate, 3,5-dimethylcyclohexane-1-methylisocyanato-2-propyl isocyanate, and ω,ω'-n-propylbiphenyl diisocyanate.

Examples of the aromatic diisocyanates include 1,3-phenylene diisocyanate, 1,4-phenylene diisocyanate, 1-methylbenzene-2,4-diisocyanate, 1-methylbenzene-2,5-diisocyanate, 1-methylbenzene-3,5-diisocyanate, 1,3-dimethylbenzene-2,4-diisocyanate, 1,3-dimethylbenzene-4,6-diisocyanate, 1,4-dimethylbenzene-2,5-diisocyanate, 1-ethylbenzene-2,4-diisocyanate, 1-isopropylbenzene-2,4-diisocyanate, diethylbenzene diisocyanate, and diisopropylbenzene diisocyanate.

Examples of the naphthalene diisocyanates include naphthalene-1,4-diisocyanate, naphthalene-1,5-diisocyanate, naphthalene-2,6-diisocyanate, naphthalene-2,7-diisocyanate, and 1,1'-dinaphtyl-2,2'-diisocyanate.

Examples of the biphenyl diisocyanates include biphenyl-2,4'-diisocyanate, biphenyl-4,4'-diisocyanate, 3,3'-dimethylbiphenyl-4,4'-diisocyanate, 3,3'-dimethoxybiphenyl-4,4'-diisocyanate, and 2-nitrobiphenyl- 4,4'-diisocyanate.

Examples of the di- or tri-phenylmethane diisocyanates and di- or tri-phenylethane diisocyanates include diphenylmethane-4,4'-diisocyanate, 2,2'-dimethyldiphenylmethane-4,4'-diisocyanate, diphenyldimethylmethane-4,4'-diisocyanate, 2,5,2',5'-tetramethyldiphenylmethane-4,4'-diisocyanate, 3,3'-dimethoxydiphenylmethane-4,4'-diisocyanate, 4,41-dimethoxybiphenyl-3,3'-diisocyanate, 4,41-diethoxyphenylmethane-3,3'-diisocyanate, 2,2'-dimethyl-5,5'-dimethoxydiphenylmethane-4,4'-diisocyanate, 3,3-dichlorodiphenyldimethylmethane-4,4'-diisocyanate, benzophenone-3,3'-diisocyanate, α,β-diphenylethane-2,4-diisocyanate, 3-nitrotriphenylethane-4,4'-diisocyanate, and 4-nitrotriphenylmethane-4,4,1-diisocyanate and derivatives thereof.

Examples of the triisocyanates include 1-methylbenzene-2,4,6-triisocyanate, 1,3,5-trimethylbenzene-2,4,6-triisocyanate, naphthalene-1,3,7-triisocyanate, biphenyl-1,3,7-triisocyanate, diphenylmethane-2,4,4'-triisocyanate, 3-methyldiphenylmethane-4,6,4'-triisocyanate, triphenylmethane-4,4',4"-triisocyanate, and diphenyl-4,4'-diisocyanatocarbamic chloride and derivatives thereof.

When a diisocyanate represented by the following formula:

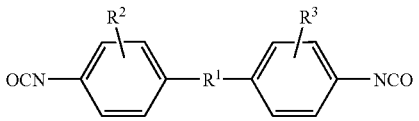

wherein, $R^1$ represents an alkylene group selected from methylene, ethylene and —$C(CH_3)_2$— groups, and $R^2$ and $R^3$ each represents a group selected from alkyl groups having 4 or less carbon atoms, alkoxy groups and halogen atom, is used as the polyisocyanate, polyurethane having excellent grindability can be obtained, leading to an improvement in the productivity of the pulverizing step in the preparation of toner particles. Specific examples of the diisocyanate represented by the above-described formula include diphenylmethane-4,4'-diisocyanate, 2,2'-dimethyldiphenylmethane-4,4'-diisocyanate, 2,2',5,5'-tetramethyldiphenylmethane-4,4'-diisocyanate, 3,3'-dimethoxydiphenylmethane-4,4'-diisocyanate, 2,2'-dimethyl-5,5'-dimethoxydiphenylmethane-4,4'-diisocyanate, 3,3'-dichlorodiphenylmethane-4,4'-diisocyanate, and α,β-diphenylmethane-4,4'-diisocyanate and derivatives thereof. Mixtures of a plurality of these diisocyanates are also preferably employed.

The polyisocyanates represented by the above-described formula each has, as a basic skeleton, a structure in which two aromatic rings are coupled via an alkylene group. By using this polyisocyanate as a hard segment component, the binder polymer has excellent grindability, because it acquires a rigid structure owing to lowering in the flexibility of the molecular chain in the binder polymer.

When the alicyclic diisocyanate compound is used as the polyisocyanate, a toner having excellent light fastness and therefore being free from facing which will otherwise be caused by long-term storage of the image can be obtained. This owes to that the cyclic aliphatic hydrocarbon structure of the alicyclic diisocyanate compound contributes to suppression of deterioration due to light or heat. The urethane resin thus obtained has high rigidity and has excellent grindability so that productivity in the pulverizing and classifying steps can be improved upon toner formation.

The alicyclic diisocyanate compound has a structure wherein two isocyanate groups are coupled directly or via an alkylene group with a cyclic aliphatic hydrocarbon or polycyclic aliphatic hydrocarbon. Examples of the alicyclic diisocyanate compound include the isophorone diisocyanate represented by the following formula:

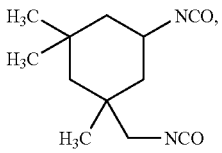

ω,ω'-1,2-dimethylcyclohexane diisocyanate, ω,ω'-1,4-dimethylcyclohexane diisocyanate, and 3,5-dimethylcyclohexane-1-methylisocyanate-2-propyl isocyanate.

Polycyclic aliphatic diisocyanates represented by the following formula:

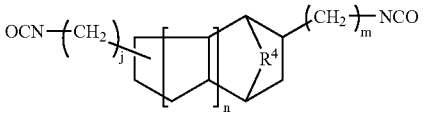

wherein, $R^4$ represents a group selected from a single bond, a methylene group, an ethylene group and a group —$C(CH_3)_2$—, j and m each stands for an integer of from 1 to 5, and n stands for an integer of from 0 to 2 are also preferred, and examples thereof include norbornane diisocyanate represented by the following formula:

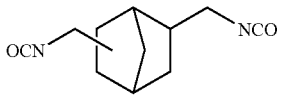

From the viewpoints of the grindability of the toner and fixing strength thereof to a recording medium after synthesis of the urethane resin by bulk polymerization, for the urethane resin of the second invention, preferred examples include diisocyanates having an alicyclic or aromatic hydrocarbon such as diphenylmethane-4,4'-diisocyanate (MDI), isophorone diisocyanate (IPDI), norbornane diisocyanate (NBDI), dicyclohexylmethane-4,4'-diisocyanate (hydrogenated MDI), p-xylylene diisocyanate, m-xylylene diisocyanate (XDI), p-phenylene diisocyanate, p-tetramethylxylylene diisocyanate, m-tetramethylxylylene diisocyanate, 1,5-naphthalene diisocyanate, triphenylmethane triisocyanate, 1,3-bis(isocyanatomethyl)cyclohexane (hydrogenated XDI), and 2,4-tolylene diisocyanate (TDI). Mixtures of two or more of these polyisocyanates may be used.

Of these, diphenylmethane-4,4'-diisocyanate (MDI) is particularly preferred.

Polyols or polyamines to be reacted with the polyisocyanates will next be described. In the second invention, for the purpose of improving the grindability during preparation of the urethane resin toner while maintaining its low temperature fixing property and offset resistance and at the same time, improving its fixing strength to a recording medium such as paper, an active hydrogen compound having at least two active hydrogen groups is preferably used as a bulky component having less freedom of disturbing crystallinity of the urethane resin.

Examples of the active hydrogen compound having at least two active hydrogen groups include aliphatic cyclic polyols and aliphatic cyclic polyamines. The aliphatic cyclic polyols include 1,4-dicyclohexanedimethanol and 1,4-cyclohexanediol, while the aliphatic cyclic polyamines include 1,4-cyclohexanedimethylamine and 1,4-cyclohexanediamine.

In order to impart the toner with desired melt properties, use of the compound represented by formula (1) shown below in combination with the aliphatic cyclic polyol or aliphatic cyclic polyamine is preferred. Examples of the compound represented by formula (1) include polyoxyalkylene bisphenol A ether compounds such as 2 to 12 moles ethylene oxide adducts of bisphenol A (which will hereinafter be called "EO adducts"), and 2 to 12 moles propylene oxide adducts of bisphenol A (which will hereinafter be called "PO adducts"). They may be used either singly or in combination. It is also possible to use, as a mixture, two or more compounds different in the number of recurring units of EO or PO group. Whet they are used as a mixture, the mixing ratio (molar ratio) is EO adducts: PO adducts=8:2 to 1:9, preferably 8:2 to 2:8, more preferably 7:3 to 4:6. In formula (1), Rs may be the same or different and one may be an ethylene group while another may be a propylene group. Depending on the number of the recurring units of EO group or PO group, the physical properties of the resulting binder polymer varies. The average value of x+y is 2 to 12, preferably 2 to 4. The number of recurring units exceeding the above-described range causes lowering in the glass transition point and deterioration of grindability. When it is excessively small, the strength, particularly bending and peeling strength lowers. The number of recurring units outside the above-described range is therefore not preferred. An increase in the ratio of the EO component enables fixing strength (bending and peeling strength) to be enhanced, but lowers the glass transition point and deteriorates the grindability. Increase in the ratio of the PO component, on the other hand, improves grindability but lowers fixing strength (bending and peeling strength). The polyoxyalkylene bisphenol A ether compound has a hydroxyl value of from 100 to 350 mg·KOH/g, and preferably from 200 to 290 mg·KOH/g. Since the polyoxylalkylene bisphenol A ether compound has bisphenol A as a basic skeleton, it has a structure with a little freedom of molecular chain and great rigidity, when reacted with polyisocyanate into a binder polymer.

The aliphatic cyclic polyol or aliphatic cyclic polyamine is added in an amount of 1 to 90 moles, preferably 5 to 100 moles, more preferably 10 to 60 moles to 100 moles of the polyoxyalkylene bisphenol A ether represented by the formula (1). Addition thereof in such an amount improves grindability and low temperature fixing property upon toner production, offset resistance at high temperatures and fixing strength, and it facilitates control of the softening point (Tm) or glass transition point (Tg) as required.

(1)

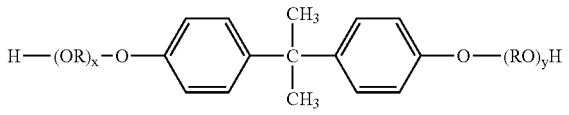

Within an extent not impairing the properties of the toner brought by the active hydrogen compound having a plurality of active hydrogen groups, another polyol such as polyethylene glycol, polypropylene glycol, polytetramethylene glycol, poly(caprolactonepolyol), poly(hexamethylene carbonate) or bis(2-hydroxyethyl) terephthalate may be added.

When the polyisocyanate is reacted with the active hydrogen compound, a ratio (active hydrogen/NCO (equivalent ratio)) of the number of active hydrogen groups of the active hydrogen compound to the number of isocyanate groups of the polyisocyanate is adjusted to fall within a range of from 0.5 to 1.0, preferably from 0.7 to 1.0. They are preferably subjected to bulk polymerization at 30° C. to 180° C., preferably 30° C. to 140° C. under atmospheric pressure in a solventless manner for several minutes to several tens of hours. Examples of the catalyst usable here include dibutyltin dichloride, dimethyltin dichloride, tin octylate, triphenylammonium dichloride, triethylamine, N,N-dimethylcyclohexylamine, triethylenediamine, dimethylaminoethanol, dioctyltin dilaurate, dioctyltin dineodecanoate, and dibutyltinbis(mercaptoate).

The reaction between the polyisocyanate and active hydrogen compound can be carried out in a solventless manner. Since a solvent indispensable for solution polymerization is not necessary and no byproduct is formed different from polycondensation, continuous production can be performed efficiently.

When a urethane resin is used as the binder resin, the binder resin mainly comprises a resin having a urethane or urea bond and may also contain other binder resin in an amount of less than 50 wt. % of the binder resin and within an extent not impairing the properties of the main component. The "other binder resin" may be mixed upon preparation of the binder resin of the second invention or may be kneaded after its preparation. When it is added upon preparation of the binder resin of the second invention, the "other binder resin" is preferably free of a reactive group with a polyisocyanate. Examples of the "other binder resin" include the above-described binder resins such as polystyrene.

As the colorant for the toner of the second invention, colorants for toner can be used. Examples of dyes or pigments usable here include carbon black, lamp black, magnetite, titanium black, chrome yellow, ultramarine blue, aniline blue, phthalocyanine blue, phthalocyanine green, Hanza yellow G, Rhodamine 6G, Chalcoil Blue, quinacrdone, Benzidine Yellow, Rose Bengale, Malachite Green lake, Quinoline Yellow, C.I. Pigment Red 48:1, C.I. Pigment Red 122, C.I. Pigment Red 57:1, C.I. Pigment Red 184, C.I. Pigment Yellow 12, C.I. Pigment Yellow 17, C.I. Pigment Yellow 97, C.I. Pigment Yellow 180, C.I. Solvent Yellow 162, C.I. Pigment Blue 5:1 and C.I. Pigment Blue 15:3. They may be used either singly or in combination.

As the releasing agent, releasing agents for toner can be used. Examples include paraffin wax, micro wax, microcrystalline wax, candellila wax, carnauba wax, rice wax, montan wax, polyethylene wax, polypropylene wax, oxidative polyethylene wax, and oxidative polypropylene wax. Of these, polyethylene wax, polypropylene wax, carnauba wax and ester wax are preferred.

To 100 parts by weight of the binder resin, the colorant is added in an amount of from 0.5 to 15 parts by weight, preferably from 1 to 10 parts by weight, the releasing agent is added in an amount of from 1 to 10 parts by weight, preferably from 2.5 to 8 parts by weight, and the charge control agent is added in an amount of from 0.1 to 0.7 parts by weight, preferably from 0.5 to 5 parts by weight.

Examples of the organic solvent forming a dispersion include ether solvents such as diethyl ether and isopropyl ether, halogenated hydrocarbon solvents such as dichloromethane, chloroform and carbon tetrachloride, ester solvents such as ethyl acetate and methyl acetate, hydrocarbon solvents such as toluene and xylene, and ketone solvents such as methyl ethyl ketone and methyl isobutyl ketone, and mixtures thereof.

The dispersion thus formed can be pulverized by pouring it in an aqueous medium containing methyl cellulose, carboxymethyl cellulose, hydroxyethyl cellulose, partially saponified product of polyvinyl alcohol, polyvinyl alcohol or calcium phosphate and treating in a homomixer.

The number-average particle size of the toner is preferably 9 μm or less, more preferably from 8 μm to 4.5 μm. When a toner having the number average particle size exceeding 9 μm is used, reproducibility of the resolution becomes inferior to that of the toner having a smaller particle size even if a latent image is formed at resolution as high as 1200 dpi or greater. When it is less than 4.5 μm, coverage by the toner lowers and amount of an external additive must be raised to height n the fluidity, resulting in the lowering tendency of the fixing performance. The number-average particle size outside the above-described range is therefore not preferred.

As an external additive for improving fluidity, silica particles are preferably added to the toner of the second invention.

As the silica particles, either of the particles prepared by the dry method using a silicon halide, etc. or the particles prepared by the wet method which are precipitated from a silicon compound in a liquid can be used.

The average particle size of the primary particles of the silica particles is preferably adjusted to fall within a range of from 7 nm to 40 nm, more preferably from 10 nm to 30 nm. When the primary particles of the silica particles have an average particle size less than 7 nm, they tend to be buried in the toner mother particles and charged negatively. When it exceeds 40 nm, the effect of the particles to impart fluidity to the toner mother particles lowers, making it difficult to uniformly charge the toner negatively. This results in an increasing tendency of the amount of the positively charged toner, that is, oppositely charged toner.

In the second invention, as the silica particles, a mixture of silica particles different in the number-average particle size distribution is preferred. Incorporation of an external additive having a greater particle size prevents it from being buried in the toner particles, while incorporation of silica particles having a smaller diameter imparts the toner particles with desirable fluidity.

More specifically, use of two kinds of silica particles, one having a number average primary particle size of from 5 nm to 20 nm, more preferably from 7 to 16 nm and the other one having a number average primary particle size of from 30 nm to 50 nm, more preferably from 30 nm to 40 nm is preferred.

The particle size of the external additive in the second invention is measured by electron microscopic observation and the number-average particle size is designated as the average particle size.

The silica particles to be used as the external additive in the second invention are preferably subjected to hydrophobic treatment with a silane coupling agent, titanium coupling agent, higher fatty acid, or silicone oil. Examples of the agent for use in hydrophobic treatment include dimethyldichlorosilane, octyltrimethoxysilane, hexamethyldisilazane, silicone oil, octyl-trichlorosilane, decyl-trichlorosilane, nonyl-trichlorosilane, (4-iso-propylphenyl)-trichlorosilane, (4-t-butylphenyl)-trichlorosilane, dipentyl-dichlorosilane, dihexyl-dichlorosilane, dioctyl-dichlorosilane, dinonyl-diochlorosilane, didecyl-dichlorosilane, didecyl-dichlorosilane, (4-t-butylphenyl)-octyl-dichlorosilane, didecenyl-dichlorosilane, dinonenyl-dichlorosilane, di-2-etylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosialne, and (4-isopropylphenyl)-diethyl-chlorosilane.

The hydrophobic treatment is effected by covering 100 parts by weight of the silica particles with 1 to 30 parts by weight of a hydroxide or oxide of the above-described substance, covering the resulting slurry with 3 to 50 parts by weight, based on the solid content of the slurry, of an alkoxysilane, neutralizing with an alkali, followed by filtration, washing, drying and pulverization.

In the second invention, the external additive is preferably added in an amount of from 0.05 to 2 parts by weight based on 100 parts by weight of the toner mother particles.

When the amount is less than 0.05 part by weight, the external additive cannot bring about fluidity imparting effects and excessive charge preventive effects. Amounts exceeding 2 parts by weight, on the other hand, lower the negative charge amount and increase the amount of a positively charged toner, resulting in an increase in fog or reverse transfer toner amount.

Third Invention

The third invention has a feature that as a toner for use in an image forming apparatus for forming a color image by transferring a toner image, which has been obtained by developing an electrostatic latent image on a photoreceptor, to a recording medium via an intermediate transfer medium, toner particles are formed by mixing a colorant and a charge control agent comprising a water soluble charge control substance incorporated in inorganic fine particles in the emulsion of a binder resin and heating the resulting mixture.

The charge control substance is stably supported on the inorganic porous material so that an elution amount thereof in water serving as a dispersing medium of the emulsion of the binder resin can be reduced. Since stable charging is not disturbed by the adhesion of the charge control agent dissolved in water to the surface of the toner particles and the charge control agent exists stably even when the solvent is removed by at least one of heating and pressure reduction, a toner having stable charge properties and free from fog or reverse charge can be obtained.

Accordingly, it is possible to provide a cleaner-less image forming apparatus which generates less transfer toner residue, suffers from less quality deterioration of the recovered toner and therefore has excellent properties, because the charge control agent exists stably and in turn, the toner has stable charge properties even when the toner of the third invention is applied to a cleaner-less image forming apparatus in which a developing drum recovers the transfer toner residue upon development of an electrostatic latent image formed on a photoreceptor.

Silicate or silica, that is, inorganic fine particles to be used as a carrier of the charge control agent is effective for dispersing the charge control agent in the binder resin and charging the resin. The charge control substance exists in the pores formed on the surface of the particles and serves to control the charge. Since the charge control substance exists inside of the pores of the inorganic porous particles and adsorbed or protected thereby, elution thereof in water serving as a dispersing medium and sublimation and decomposition thereof upon heating or pressure reduction in the manufacturing step can be suppressed.

As a result, it is possible to prevent adhesion of the charge control agent to the surface of the particles upon formation of the toner particles by aggregation in a liquid, or sublimation or oxidative decomposition thereof in the subsequent solvent removal step by heating or pressure reduction, and therefore the charge control agent exists stably and uniformly. This brings about effects for reducing fog and reverse transfer of the toner.

The charge control agent in the toner of the third invention has a feature that it has a charge control substance incorporated in an inorganic porous material.

Examples of the inorganic porous material include silica gel, montmorillonite, bentonite, hectorite, kaolinite, serpentine, talc, pyrophyrite feldspar, zeolite, wollastonite and sillimanite. At least one of them can be used as the inorganic porous material.

The inorganic porous material preferably has a number-average particle size of from 5 μm to 100 μm, more preferably from 30 μm to 70 μm.

When it is greater than 100 μm, the toner mother particles tend to form irregularities on their surfaces upon production, while when it is less than 5 μm, complete pores cannot be formed and the charge control substance cannot be supported therein. The number-average particle sizes outside the above-described range are therefore not preferred.

The pore size is preferably 0.5 nm to 10 m. At a pore size less than 0.5 nm, it is difficult to support the charge control substance in the pores, while at a pore size greater than 10 nm, the charge control substance is apt to fall from the pore.

The charge control agent to be use in the third invention can be prepared by treating the above-described inorganic fine particles with a solution containing a water soluble charge control substance at a predetermined concentration to have the substance supported by the inorganic fine particles. Specific examples of the charge control substance include phosphonium ion, metal elements or positive ions thereof, ammonia or derivatives thereof, phosphine or derivatives thereof, ammonium or salts of its derivative, salts of a phosphonium derivative, carbonium ion, alkanes, alkenes, alkynes, aromatic and polycyclic alkanes, alkenes and alkynes, complex salts, silicate-based inorganic anions, and salts of an organic cation.

Examples of the binder resin usable in the third invention include copolymers of a styrene-based monomer, alkyl (meth)acrylate and the like Styrene-based monomers include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, and p-chloromethylstyrene. Of these, styrene is particularly preferred.

Alkyl (meth)acrylates include methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate and stearyl methacrylate. Of these, (meth)acrylates of an aliphatic alcohol having 1 to 12 carbon atoms, preferably 3 to 8 carbon atoms, particularly 4 carbon atoms are preferred.

Examples of the monomer having an acidic polar group include α,β-ethylenically unsaturated compounds having a carboxyl or sulfonic group. Specific examples include acrylic acid, methacrylic acid, fumaric acid, maleic acid, itaconic acid, cinnamic acid, monobutyl maleate, and monooctyl maleate and metal salts thereof such as sodium salts and zinc salts.

Examples of the α,β-ethylenically unsaturated compounds having a sulfonic group include sulfonated stylene, sodium salts thereof, allylsulfosuccinic acid, octyl allylsulfosuccinate and sodium salt thereof.

Examples of the monomer having a basic polar group include (meth)acrylates of an amine- or quaternary-ammonium-containing aliphatic alcohol having 1 to 12, preferably 2 to 8, particularly preferably 2 carbon atoms, (meth)acrylic acid amide or (meth)acrylic acid amide mono- or di-substituted with a $C_{1-18}$ alkyl group, vinyl compounds substituted with a nitrogen-containing heterocyclic group, and N,N-diallyl-alkylamines or quaternary ammonium salts thereof. Of these, (meth)acrylates of an amine- or quaternary-ammonium-containing aliphatic alcohol are preferred as a comonomer having a basic group.

Examples of the (meth)acrylates of an amine- or quaternary-ammonium-containing aliphatic alcohol include dimethylaminoethyl acrylate, dimethylaminoethyl methacrylate, diethylaminoethyl acrylate, diethylaminoethyl methacrylate and quaternary ammonium salts thereof such as 3-dimethylaminophenyl acrylate and 2-hydroxy-3-methacryloxypropyltrimethylammonium salt.

Examples of the (meth)acrylamide or (meth)acrylamide mono- or di-substituted with alkyl include acrylamide, N-butylacrylamide, N,N-dibutylacrylamide, piperidyl acrylamide, methacrylamide, N-butylmethacrylamide, N,N-dimethylacrylamide and N-octadecylacrylamide.

Examples of the vinyl compound substituted with a nitrogen-containing heterocyclic group include vinyl pyridine, vinyl pyrrolidone, vinyl N-methylpyridinium chloride and vinyl N-ethylpyridinium chloride.

Examples of N,N-diallylalkylamine include N,N-diallylmethylammonium chloride and N,N-diallylethylammonium chloride.

The glass transition point of the polymer having a polar group which polymer is usable in the third invention is from −90 to 100° C., preferably from −30 to 80° C., most preferably from −10 to 60° C. The gelation degree thereof is from 0 to 99.9 wt. %, preferably from 1 to 30 wt. %, each in terms of an insoluble content upon Soxhlet extraction under an acetone reflux. At the glass transition point exceeding 100° C., low-temperature fixing property tends to lower, while at the glass transition point less than 90° C., the powder fluidity of the toner tends to lower. Thus, the glass transition point outside the above-described range is not preferred. The gelation degree exceeding 50 wt. % is not preferred, because it tends to deteriorate low temperature fixing property.

In the toner of the third invention, a colorant and the charge control agent comprising a water soluble charge control substance incorporated in inorganic fine particles are added to an emulsion of a polymer having a binder resin, which emulsion has been obtained by emulsion polymerization, and they are mixed to uniformly disperse the former in the latter. Continuous stirring of the dispersion under heating causes aggregation of primary particles of the polymer having a polar group, the colorant particles and charge control agent. The associated particles then gradually grow into secondary particles. After gradual cooling to room temperature until the secondary particles become a predetermined average size, an acid is added thereto and the resulting toner particles are collected through suction filtration. After cleaning is repeated until the filtrate becomes neutral, the collected particles are dried under reduced pressure, crushed in an air stream and separated through a ultrasonic sieve, by which toner mother particles can be obtained.

As the colorant for the toner of the third invention, colorants for toner can be used. Examples of dyes or pigments usable here include carbon black, lamp black, magnetite, titanium black, chrome yellow, ultramarine blue, aniline blue, phthalocyanine blue, phthalocyanine green, Hanza yellow G, Rhodamine 6G, Chalcoil Blue, quinacrdone, Benzidine Yellow, Rose Bengale, Malachite Green lake, Quinoline Yellow, C.I. Pigment Red 48:1, C.I. Pigment Red 122, C.I. Pigment Red 57:1, C.I. Pigment Red 184, C.I. Pigment Yellow 12, C.I. Pigment Yellow 17, C.I. Pigment Yellow 97, C.I. Pigment Yellow 180, C.I. Solvent Yellow 162, C.I. Pigment Blue 5:1 and C.I. Pigment Blue 15:3. They may be used either singly or in combination.

As the releasing agent, releasing agents for toner can be used. Examples include paraffin wax, micro wax, microcrystalline wax, candellila wax, carnauba wax, rice wax, montan wax, polyethylene wax, polypropylene wax, oxidative polyethylene wax, and oxidative polypropylene wax. Of these, polyethylene wax, polypropylene wax, carnauba wax and ester wax are preferred.

To 100 parts by weight of the binder resin, the colorant is added in an amount of from 0.5 to 15 parts by weight, preferably from 1 to 10 parts by weight, the releasing agent is added in an amount of from 1 to 10 parts by weight, preferably from 2.5 to 8 parts by weight, and the charge control agent is added in an amount of from 0.1 to 7 parts by weight, preferably from 0.5 to 5 parts by weight.

The number-average particle size of the toner is preferably 9 μm or less, more preferably from 8 μm to 4.5 μm. When a toner having the number average particle size exceeding 9 μm is used, reproducibility of the resolution becomes inferior to that of the toner having a smaller particle size even if a latent image is formed at resolution as high as 1200 dpi or greater. When it is less than 4.5 μm, coverage by the toner lowers and amount of an external additive must be raised to heighten the fluidity, resulting in the lowering tendency of the fixing performance. The number-average particle size outside the above-described range is therefore not preferred.

As an external additive for improving fluidity, silica particles are preferably added to the toner of the third invention.

As the silica particles, either of the particles prepared by the dry method using a silicon halide, etc. or the particles prepared by the wet method which are precipitated from a silicon compound in a liquid can be used.

The average particle size of the primary particles of the silica particles is preferably adjusted to fall within a range of from 7 nm to 40 nm, more preferably from 10 nm to 30 nm. When the primary particles of the silica particles have an average particle size less than 7 nm, they tend to be buried in the toner mother particles and charged negatively. When it exceeds 40 nm, the effect of the particles to impart fluidity to the toner mother particles lowers, making it difficult to uniformly charge the toner negatively. This results in an increasing tendency of the amount of the positively charged toner, that is, oppositely charged toner.

In the third invention, as the silica particles, a mixture of silica particles different in the number-average particle size distribution is preferred. Incorporation of an external additive having a greater particle size prevents it from being buried in the toner particles, while incorporation of silica particles having a smaller diameter imparts the toner particles with desirable fluidity.

More specifically, use of two kinds of silica particles, one having a number average primary particle size of from 5 nm to 20 nm, more preferably from 7 to 16 nm and the other one having a number average primary particle size of from 30 nm to 50 nm, more preferably from 30 nm to 40 nm is preferred.

The particle size of the external additive in the third invention is measured by electron microscopic observation and the number-average particle size is designated as the average particle size.

The silica particles to be used as the external additive in the third invention are preferably subjected to hydrophobic treatment with a silane coupling agent, titanium coupling agent, higher fatty acid, or silicone oil. Examples of the agent for use in hydrophobic treatment include dimethyldichlorosilane, octyltrimethoxysilane, hexamethyldisilazane, silicone oil, octyl-trichlorosilane, decyl-trichlorosilane, nonyl-trichlorosilane, (4-iso-propylphenyl)-trichlorosilane, (4-t-butylphenyl)-trichlorosilane, dipentyl-dichlorosilane, dihexyl-dichlorosilane, dioctyl-dichlorosilane, dinonyl-diochlorosilane, didecyl-dichlorosilane, didecyl-dichlorosilane, (4-t-butylphenyl)-octyl-dichlorosilane, didecenyl-dichlorosilane, dinonenyl-dichlorosilane, di-2-etylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosialne, and (4-isopropylphenyl)-diethyl-chlorosilane.

The hydrophobic treatment is effected by covering 100 parts by weight of the silica particles with 1 to 30 parts by weight of a hydroxide or oxide of the above-described substance, covering the resulting slurry with 3 to 50 parts by weight, based on the solid content of the slurry, of an alkoxysilane, neutralizing with an alkali, followed by filtration, washing, drying and pulverization.

In the third invention, the external additive is preferably added in an amount of from 0.05 to 2 parts by weight based on 100 parts by weight of the toner mother particles.

When the amount is less than 0.05 part by weight, the external additive cannot bring about fluidity imparting effects and excessive charge preventive effects. Amounts exceeding 2 parts by weight, on the other hand, lower the negative charge amount and increase the amount of a positively charged toner, resulting in an increase in fog or reverse transfer toner amount.

Next, the image forming apparatus of the present invention will be described in more detail below.

Image Forming Apparatus

FIG. 1 illustrates one example of a contact development system image forming apparatus using the toner of the present invention. A photoreceptor 1, which is in the form of a drum, has a diameter of from 24 to 86 mm and rotates at a surface velocity of from 60 to 300 mm/s. After its surface is uniformly and negatively charged by a corona charger 2, exposure by an exposing unit 3 is conducted in accordance with the information to be recorded, by which an electrostatic latent image is formed.

The developing unit 10 is a developing unit for single-component toner which feeds a single-component nonmagnetic toner T to an organic photoreceptor to carry out reversal development of an electrostatic latent image on the organic photoreceptor and visualize it. The developing unit has the single-component nonmagnetic toner T stored therein and as illustrated in FIG. 1, a toner is fed to a developing roller 9 from the toner feed roller 7 rotating in a counterclockwise direction. The developing roller 9 rotates in the counterclockwise direction and carries the toner T, which has been fed from the toner feed roller 7, to a contact portion with the organic photoreceptor while retaining the toner on the surface of the developing roller. In this manner, the electrostatic latent image on the organic photoreceptor 1 is visualized.

The developing roller 9 has, for example, a diameter of from 16 to 24 mm; and is made of a plated or blasted metal tube, or has, on the circumferential surface of the center shaft, a conductive elastic layer formed. This conductive elastic layer is made of a butadiene rubber, styrene butadiene rubber, ethylene propylene rubber, urethane rubber or silicone rubber, has a volume resistivity of from $10^4$ to $10^8$ Ω·cm and hardness (Asker A hardness) of 40 to 70°. From an unillustrated power source, a developing bias voltage is applied via the shaft of this tube. The developing unit 10 having the developing roller 9, toner feed roller 7 and toner regulating blade 8 is preferably brought into contact with the organic photoreceptor under pressure by an unillustrated biasing means such as spring so that the pressure applied is from 19.6 to 98.1 N/m, preferably from 24.5 to 68.6 N/m with a nip width of from 1 to 3 mm.

As the regulating blade 8, those obtained by adhering a rubber chip to stainless, phosphor bronze, rubber plate or thin metal plate can be used. It is recommended to press the regulating blade against the developing roller under a linear pressure of from 245 to 490 mN/cm by a biasing means such as spring or by making use of the repulsion of the elastic body and stack at least two toner layers over the developing roller.

In the contact development system, it is preferred that the dark potential of the photoreceptor is from −500 to −700V, the light potential is from −50 to −150V, and the development bias voltage, which is not illustrated, is from −100 to −400V. The developing roller preferably has an equal potential to that of the toner feed roller.

In the contact development system, the ratio of the circumferential speed of the developing roller rotating in the counterclockwise direction to the circumferential speed of the organic photoreceptor rotating in the clockwise direction is preferably set at 1.2 to 2.5, preferably 1.5 to 2.2. This ensures contact friction charging with the organic photoreceptor even if the toner particles have a small diameter.

Although there is no particular limitation imposed on the relationship between the work function of each of the regulating blade and developing roller and the work function of the toner, toner can be uniformly charged negatively by charging the toner, which is to be brought into contact with the regulating blade, negatively while controlling the work function of each of the regulating blade and developing roller to be smaller than that of the toner. Alternatively, the toner charge amount may be controlled by applying a voltage to the regulating blade 8, thereby injecting a charge to the toner to be brought into contact with the blade.

In the cleaner-less system image forming apparatus, the transfer residue toner remaining on the photoreceptor even after the transfer can be recovered by controlling a bias voltage of the developing roller 9 and then used for the development.

In the next place, the intermediate transfer medium adopted by the image forming apparatus of the present invention will next be described. In FIG. 1, the intermediate transfer medium 4 is fed between the photoreceptor 1 and a backup roller 6. When a voltage is applied, a visible image on the photoreceptor 1 is transferred onto the intermediate transfer medium, whereby a toner image is formed on the intermediate transfer medium. The toner remaining on the photoreceptor is removed by a cleaning blade 5. The static charge on the photoreceptor is erased by an erase lamp, and the resulting photoreceptor is provided for re-use. Since the amount of an oppositely charged toner can be suppressed in the image forming apparatus of the present invention, the toner amount remaining on the photoreceptor can be decreased, leading to a size reduction of the cleaning toner container.

When a transfer drum or transfer belt is employed as the intermediate transfer medium, it is recommended to apply, as a primary transfer voltage, a voltage of from +250 to +600V to its conductive layer and apply, as a secondary transfer voltage, a voltage of from +400 to +2800V to a transfer material such as paper upon secondary transfer.

Thus, a transfer belt or transfer drum is usable as the intermediate transfer medium.

The transfer belt has a transfer layer disposed over a film or sheet made of a synthetic resin substrate or has a transfer layer disposed as an outer layer over the substrate of an elastic member. The transfer drum serving as a transfer medium, on the other hand, has a transfer layer disposed as an elastic outer layer on the substrate of a rigid drum such as an aluminum drum, when an organic photosensitive layer is disposed on a rigid photoreceptor drum such as an aluminum drum. When the photoreceptor is so-called an elastic photoreceptor having a photosensitive layer disposed on a belt or an elastic support such as rubber, the transfer medium preferably has a transfer layer disposed on the substrate of a rigid drum such as aluminum drum directly or via a conductive intermediate layer.

As the substrate, a conductive or insulating substrate is usable. In the case of the transfer belt, the substrate preferably has a volume resistivity of from $10^4$ to $10^{12}$ Ω·cm, preferably $10^6$ to $10^{11}$ Ω·cm.

The materials and method suitable for forming the film or sheet will next be described. The seamless belt is obtained by dispersing a conductive material such as conductive carbon black, conductive titanium oxide, conductive tin oxide, or conductive silica in an engineering plastic such as modified polyimide, thermosetting polyimide, polycarbonate, ethylene tetrafluoroethylene copolymer, polyvinylidene fluoride, or nylon alloy, forming or molding the resulting dispersion into a semiconductive film substrate having a thickness of from 50 to 500 μm as a seamless substrate, and covering the outside of the substrate with a fluorine resin to give a thickness of from 5 to 50 μm as a surface protective layer for lowering the surface energy and preventing filming of toner.

The forming method of the surface protective layer may be a dip coating method, a ring coating method, a spray coating method, or the like method. To prevent cracks or elongation and serpentine motion at the ends of the transfer belt, tapes of polyethylene terephthalate film or ribs of polyurethane rubber having a thickness of 80 μm are attached to the both ends of the transfer belt.

When the substrate is made of a film or sheet, end surfaces of the film or sheet are subjected to ultrasonic welding to form it as a belt. More specifically, the transfer belt having desired physical properties is available by disposing a conductive layer and an outer layer on the sheet or film and then, carrying out ultrasonic welding. Furthermore specifically, the transfer belt is available by depositing aluminum on the surface of polyethylene terephthalate of 60 to 150 μm thick, when it is used as an insulating substrate, and optionally applying an intermediate conductive layer comprising a conductive material such as carbon black and a resin, and overlaying a semiconductive outer layer made of a urethane resin, a fluorine resin and a conductive material resin having a surface resistivity higher than that of the intermediate conductive layer. When a resistance layer which does not require a large amount of heat upon drying after application can be disposed, the transfer belt may be made by disposal of the resistance layer after ultrasonic welding of an aluminum-deposited film.

Materials and method suitable for forming the elastic substrate such as rubber will next be described. The elastic substrate can be obtained by dispersing the above-described conductive material in silicone rubber, polyurethane rubber, nitrile rubber or ethylene propylene rubber, extruding the resulting dispersion into a semiconductive rubber belt having a thickness of from 0.8 to 2.0 mm, controlling the surface of the belt by an abrasive such as a sand paper or polisher to have a desired surface roughness. The elastic layer may be used without any additional layer thereon, but a surface protective layer may be disposed thereon as in the described case.

The transfer drum preferably has a volume resistivity of $10^4$ to $10^{12}$ Ω·cm, preferably $10^7$ to $10^{11}$ Ω·cm. The transfer drum can be manufactured by disposing, if necessary, an elastic conductive intermediate layer on a metal cylinder made of aluminum or the like to cause it to function as a conductive elastic substrate, and then covering the substrate with a fluorine resin to give a thickness of from 5 to 50 μm as a semiconductive surface protective layer for lowering the surface energy and preventing the filming of the toner.

More specifically, the transfer drum having a desired volume resistivity of from $10^7$ to $10^{11}$ Ω·cm can be manufactured by adding a conductive material such as carbon black, conductive titanium oxide, conductive tin oxide, or conductive silica to a rubber material such as silicone rubber, polyurethane rubber, nitrile rubber (NBR), ethylene propylene rubber (EPDM), butadiene rubber, styrene-butadiene rubber, isoprene rubber, chloroprene rubber, butyl rubber, epichlorohydrin rubber, or fluororubber, kneading and dispersing the resulting mixture to yield a conductive rubber material; bonding the resulting conductive rubber material closely to an aluminum cylinder having a diameter of from 90 to 180 mm so that the thickness and volume resistivity after polishing would be of 0.8 to 6 mm and $10^4$ to $10^{10}$ Ω·cm, respectively; and then forming a semiconductive surface layer made of polyurethane resin, fluororesin, conductive material, and fluorine fine particles to give a film thickness of about 15 to 40 μm. At this time, the surface roughness is preferably 1 μm (Ra) or less. Alternatively, the transfer drum having a desired surface layer and resistivity can be manufactured by covering the conductive elastic substrate thus prepared with a semiconductive tube made of a fluororesin, and heating them to shrink.

Figure 2:
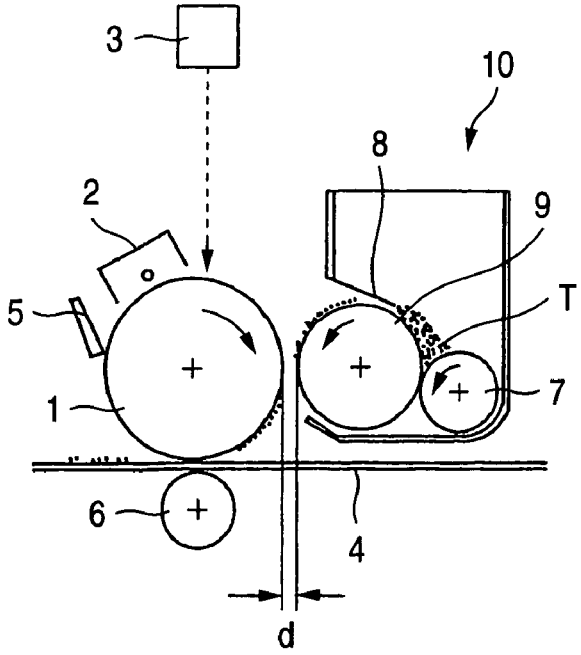
FIG. 2 illustrates an example of a non-contact development system image forming apparatus using the toner of the present invention.

FIG. 2 illustrates one example of a non-contact development system image forming apparatus for which the toner of the present invention is used. In this system, the developing roller 9 and the photoreceptor 1 are opposed each other with a developing gap d therebetween. The developing gap is preferably set at from 100 to 350 μm. It is preferred to set the developing bias of the d.c. voltage to fall within a range of from −200 to −500 V, an a.c. voltage to be superimposed on the d.c. voltage to fall within a range of from 1.5 to 3.5 kHz, and P—P voltage to fall within a range of from 1000 to 1800 V, which are however not illustrated. In the non-contact development system, a ratio of the circumferential velocity of the developing roller rotating in the counterclockwise direction to that of the organic photoreceptor rotating in the clockwise direction is preferably set at 10 to 2.5, preferably 1.2 to 2.2.

The developing roller 9 rotates in the counterclockwise direction as shown in FIG. 2. It carries Toner T fed from the toner feed roller 7 to a portion opposite to the organic photoreceptor while having the toner T adsorbed on the surface thereof. By applying a superimposed a.c. voltage to the portion at which the organic photoreceptor and the developing roller are opposed each other, the toner. T vibrates between the surface of the developing roller and the surface of the organic photoreceptor to develop an image. In the present invention, it is possible to negatively charge the positively charged toner having small particle size and thereby decrease fog, because the toner particles can be brought into contact with the photoreceptor while an a.c. voltage applied causes vibration of the toner T between the surface of the developing roller and the surface of the organic photoreceptor.

The intermediate transfer medium is sent between the photoreceptor 1 which has developed an image and backup roller 6. It is recommended to increase the pressure to the photoreceptor 1 from the backup roller 6 by about 30% compared with the pressure to be applied in the contact development system, more specifically, to set the pressure at from 24.5 to 58.8 N/m, preferably from 34.3 to 49 N/m.

This makes it possible to bring the toner particles and the photoreceptor into stable contact, charge the toner particles negatively and improve a transfer efficiency.

The non-contact development system is similar to the contact development system except for the above-described matters.

When the development process as described in FIG. 1 or FIG. 2 is used in combination with a developing unit and a photoreceptor for four toners (developers) made of yellow Y, cyan C, magenta M and black K, such an apparatus serves as a full color image forming one.

EXAMPLES

The present invention will be illustrated in greater detail with reference to the following Examples and Comparative Examples, but the invention should not be construed as being limited thereto.

Preparation of Charge Control Agent 1A

After 100 g of zeolite (volume average diameter of 60 μm, BET specific surface area of 130 m/g) was dispersed in 500 ml of toluene, 50 g of Charge Control Substance 1A (Polysaccharide-based charge control substance "NCA", product of Clariant Japan) was added to the dispersion. The resulting mixture was stirred at 50° C. for 2 hours to prepare a suspension. A solid matter was collected by filtration from the suspension, dried, allowed to stand at 120° C. for 3 hours under normal pressure and then crushed in a mill, whereby a powder having a volume average particle size of 80 μm was obtained.

Preparation of Charge Control Agent 2A

After 100 g of silica gel (volume average particle size: 60 μm, BET specific surface area: 300 m/g) was dispersed in 100 g of toluene, 50 g of Charge Control Substance 2A (chromium di-t-butylsalicylate, "Bontron E-81", trade name, product of Orient Chemical Industries, Ltd.) was added to the dispersion. The resulting mixture was stirred at 50° C. for 2 hours to prepare a suspension. A solid matter was collected by filtration from the suspension, dried, allowed to stand at 120° C. for 3 hours under normal pressure and then crushed in a mill, whereby a powder having a volume average particle size of 100 μm was obtained.

Preparation of Charge Control Agent 3A

After 100 g of alkali bentonite (volume average particle size of 40 μm, BET specific surface area of 210 $m^2/g$) was dispersed in water, the resulting dispersion was neutralized with sulfuric acid. Charge Control Substance 3A (zinc di-t-butylsalicylate, "Bontron E-84", trade name; product of Orient Chemical Industries, Ltd., 50 g) was added and the mixture was stirred at 60° C. for 2 hours. A solid matter was collected by filtration from the suspension, washed with pure water, dried, allowed to stand at 60° C. for 3 hours under reduced pressure and then crushed in a mill, whereby a powder having a volume average particle size of 50 μm was obtained.

Preparation of Toner Resin 1A

As Polyol (PO1), polyoxyethylene bisphenol-A-ether ("Uniol DA-400", trade name; product of NOF, OH value: 273 mg·KOH/g) and as Polyol (PO2), dimethylol butanoic acid ("DMBA", trade name; product of Nippon Kasei, acid value: 375 mg·KOH/g, OH value: 748 mg·KOH/g) were dissolved by heating at 120° C. at a PO1:PO2 molar ratio of 70:30 to prepare Polyol (PO3).

Polyurethane Resin 1A was prepared by mixing and dissolving 171 g of Polyol 3 (PO3), 129 g of diphenylmethane-4,4'-diisocyanate isocyanate and, as a catalyst, dioctyltin dilaurate under heating at 120° C., pouring the resulting solution in a dish of 200 mm×300 mm, maintaining the solution at 120° C. for 1 hour in an air bath, and maintaining the resulting solution at 130° C. for 5 hours to complete the reaction.

Polyurethane Resin 1A thus obtained had a glass transition point Tg of 76° C. as measured by differential scanning calorimeter ("DSC-220/EXTRA6000 PC Station", trade name; manufactured by Seiko Instruments Inc.).

The softening point Tm of a cylindrical sample obtained by compression molding was measured under the conditions of pressure of 1.96 MPa, die orifice size of 1 mm and die length of 1 mm by using a constant pressure extrusion type capillary rheometer ("Flow Tester CFD-500D", trade name; product of Shimadzu Corporation). The softening point Tm thereof was 126° C.

Preparation of Toner Resin 2A

To 100 parts by weight of a sample obtained by mixing 1,4-butanediol, fumaric acid and trimellitic anhydride at a 50:47:3 molar ratio was added 5 parts by weight of hydroquinone. The mixture was reacted in a 5-liter four-necked flask equipped with a nitrogen inlet tube, dehydrating tube, stirrer and thermocouple at 160° C. for 5 hours, followed by reaction for 1 hour at a temperature increased to 200° C. The reaction was effected for further 1 hour under pressure of 8.1 kPa, whereby crystalline polyester was obtained.

Preparation of Toner Resin 3A

To 100 parts by weight of a sample obtained by mixing polyoxypropylene bisphenol-A ether, terephthalic acid and fumaric acid at a 75:50:15 molar ratio was added 4 parts by weight of dibutyltin oxide. The mixture was reacted in a 5-liter four-necked flask equipped with a nitrogen inlet tube, dehydrating tube, stirrer and thermocouple at 220° C. for 8 hours, followed by reaction under pressure of 8.1 kPa until the softening point became 100° C., whereby amorphous polyester was obtained.

Preparation of Toner 1A

After uniform mixing of 100 parts by weight of Polyurethane Resin 1A prepared in advance, 5 parts by weight of a pigment ("ECR-101", trade name; product of Dainichiseika Color & Chemicals Mfg. Co., Ltd.), 1 part by weight of a release agent ("Purified Carnauba Wax Type #1, trade name; product of Nippon Wax Co., Ltd.) and 3 parts by weight of Charge Control Agent 1A prepared in advance in a Henschel mixer, the resulting mixture was kneaded in a twin screw extruder. The kneaded product was cooled. The cooled product was pulverized in a jet mill, followed by classification by an air-flow type classifier, whereby toner mother particles 1A having an average particle size of 8 μm was obtained.

The average particle size was indicated by volume distribution D50 as measured by resistance-method particle size analyzer ("Multisizer III", trade name; product of Beckman Coulter, Inc).

Toner mother particles 1A thus obtained were conglobated by a hot air conglobation apparatus ("Surfusing System SFS-3", trade name; product of Nippon Pneumatic Industry) while setting the inlet hot air temperature of 300° C., hot air flow rate of 1.0 $m^3$, raw material charging velocity of 1.0 kg/h and hot air treatment time of 0.03 s.

After the particle-conglobation treatment, 0.5 part by weight of a hydrophobic silica ("RX200", trade name; product of Nippon Aerosil Co., Ltd., particle size: 12 nm) was added to 100 parts by weight of the resulting toner mother particles was added and the resulting mixture was stirred in a Henschel mixer, whereby magenta-color Toner 1A was obtained.

Preparation of Toner 2A

In the same manner as that employed for the preparation of Toner 1A except for the use of Charge Control Agent 2A instead of Charge Control Agent 1A, Toner 2A was prepared.

Preparation of Toner 3A

In the same manner as that employed for the preparation of Toner 1A except for the use of Charge Control Agent 3A instead of Charge Control Agent 1A, Toner 3A was prepared.

Preparation of Toner 4A

In the same manner as that employed for the preparation of Toner 1A except that 100 parts by weight of Toner Resin 1A was replaced with 50 parts by weight of Toner Resin 2A and 50 parts by weight of Toner Resin 3A, Toner 4A was prepared.

Preparation of Comparative Toners

In the same manner as that employed for the preparation of Toners 1A to 4A except that Charge Control Agents 1A to 3A were replaced with charge control agents obtained by mixing 1 part by weight of the corresponding Charge Control Agent and 2 parts by weight of inorganic fine particles without carrying out the adsorption treatment to the inorganic fine particle as described in the preparation of the charge control agent, Comparative Toners 1A to 4A were prepared, respectively.

Evaluation of Fog

Each toner to be evaluated for fog was filled in the developing unit of a color laser printer ("LP-3000C", product of Seiko Epson Corp.) serving as an image forming apparatus, and printing was performed only with white (solid white). During printing, the printer was stopped and the photoreceptor was taken out. An adhesive tape ("Scotch Mending Tape", product of Sumitomo 3M) was adhered to a point at which the photoreceptor was brought into contact with a transfer medium, that is, a point at which a transfer nip, a developing roller and the photoreceptor come close each other, that is, a region of a development nip to stick the fog-causing toner to the tape. The resulting tape was attached to high quality paper. As well as the adhesive tape for measuring fog, another adhesive tape without treatment was adhered directly to the high quality paper. Their colors were measured by a chromameter ("CR-221", product of Minolta Camera, Co., Ltd.). The results are shown in Table 1A. In Table 1A, Comparative Toners 1A to 4A are shown as Comp. 1A to Comp. 4A, respectively.

Evaluation of Transfer Property

As in the evaluation of the fog, a solid image was formed so that the deposition amount of the toner onto the photoreceptor would be 0.4 mg/cm. After the transfer of this image to the transfer medium from the photoreceptor, the printer was terminated and the photoreceptor was taken out. Downstream of the transfer nip, a mending tape was adhered to transfer the transfer toner residue thereto. The mending tape was applied to paper J. A color difference between the tape and reference value was measured. The smaller the color difference, the better the transfer property.

Stress Relaxation Measuring Method

A ratio G(t)=G(t=0.01 s)/G(t=0.03 s) of a relaxation modulus G (t=0.01 s) at a relaxation time t=0.01 s to a relaxation modulus G (t=0.03 s) at a relaxation time t=0.03 s as determined by the measurement of viscoelasticity in the stress relaxation measurement mode was measured using a dynamic viscoelasticity analyzer ("ARES", trade name; product of Rheometric Scientific FE) under the below-described conditions. The results are shown in Table 1A.

Measurement conditions:

Measuring temperature: 150° C.

Strain applied: A great strain (frequency: 1 rad/sec, strain: 0.1 to 200%) was applied gradually to a sample to be measured at a fixed temperature in a strain depending mode and the strain at which a storage modulus and loss modulus showed the maximum values in a linear region was designated as a measurement strain.

Geometry: parallel plate (diameter: 25 mm)

Sample to be measured: between parallel plates, 1 g of toner was sandwiched. It was melted under heat to give a height of 1.4 mm.

TABLE 1A

| | Ex. 1A | Ex. 2A | Ex. 3A | Ex. 4A | Comp. Ex. 1A | Comp. Ex. 2A | Comp. Ex. 3A | Comp. Ex. 4A |
|---|---|---|---|---|---|---|---|---|
| Fog | 0.5 | 0.3 | 0.8 | 0.9 | 3.3 | 2.1 | 1.8 | 3.5 |
| Transfer property | 0.6 | 0.1 | 0.2 | 0.8 | 1.8 | 2.0 | 1.9 | 2.1 |
| G(t) | 2.3 | 4.5 | 6.3 | 5.5 | 2.9 | 5.3 | 6.0 | 5.2 |

The toner of the first invention has a charge control agent having a charge control substance supported in the pores of an inorganic porous material so that even if the toner particles are subjected to thermal fairing treatment, the charge control agent retained in the inorganic porous material exists stably. As a result, owing to stable charge properties, neither oppositely charged toner nor fog appears and an image with excellent quality can be formed even if it is used in a color image forming apparatus having an intermediate transfer medium.

Preparation of Charge Control Agent 1B

After 100 g of zeolite (volume average particle size of 60 μm, BET specific surface area of 130 m/g) was dispersed in 500 ml of toluene, 50 g of Charge Control Substance 1B (Polysaccharide-based charge control substance "NCA", product of Clariant Japan) was added. The resulting mixture was stirred at 50° C. for 2 hours to prepare a suspension. A solid matter was collected by filtration from the suspension, dried, allowed to stand at 120° C. for 3 hours under normal pressure and then crushed in a mill, whereby a powder having a volume average particle size of 80 μm was obtained.

Preparation of Charge Control Agent 2B

After 100 g of silica (volume average particle size: 60 μm, BET specific surface area: 300 m/g) was dispersed in toluene, 50 g of Charge Control Substance 2B (chromium di-t-butylsalicylate, "Bontron E-81", trade name, product of Orient Chemical Industries, Ltd.) was added. The resulting mixture was stirred at 50° C. for 2 hours to prepare a suspension. A solid matter was collected by filtration from the suspension, dried, allowed to stand at 120° C. for 3 hours under normal pressure and then crushed in a mill, by which a powder having a volume average particle size of 100 μm was obtained.

Preparation of Charge Control Agent 3B

After 100 g of alkali bentonite (volume average particle size of 40 μm, BET specific surface area of 210 $m^2$/g) was dispersed in water, the resulting dispersion was neutralized with sulfuric acid. Charge Control Substance 3B (zinc di-t-butylsalicylate, "Bontron E-84", trade name; product of Orient Chemical Industries, Ltd., 50 g) was added and the mixture was stirred at 60° C. for 2 hours. A solid matter was collected by filtration from the suspension, washed with pure water, dried, allowed to stand at 60° C. for 3 hours under reduced pressure, and then crushed in a mill, whereby a powder having a volume average particle size of 50 μm was obtained.

Preparation of Toner Resin 1B

As Polyol (PO1), polyoxyethylene bisphenol-A-ether ("Uniol DA-400", trade name; product of NOF, OH value: 273 mg·KOH/g) and as Polyol (PO2), dimethylol butanoic acid ("DMBA", trade name; product of Nippon Kasei, acid value: 375 mg·KOH/g, OH value: 748 mg·KOH/g) were dissolved by heating at 120° C. at a PO1:PO2 molar ratio of 70:30 to prepare Polyol (PO3).

Polyurethane R sin 1B was prepared by mixing and dissolving 171 g of Polyol 3 (PO3), 129 g of diphenylmethane-4,4'-diisocyanate isocyanate and, as a catalyst, dioctyltin dilaurate under heating at 120° C., pouring the resulting solution in a dish of 200 mm×300 mm, maintaining the solution at 120° C. for 1 hour in an air bath, and maintaining the resulting solution at 130° C. for 5 hours to complete the reaction.

Polyurethane Resin 1B thus obtained had a glass transition point Tg of 76° C. as measured by differential scanning calorimeter ("DSC-220/EXTRA6000 PC Station", trade name; manufactured by Seiko Instruments Inc.).

The melting point of a cylindrical sample obtained by compression molding was measured under the conditions of pressure of 1.96 MPa, die orifice size of 1 mm and die length of 1 mm by using a constant pressure extrusion type capillary rheometer ("Flow Tester CFD-500D", trade name; product of Shimadzu Corporation). The melting point Tm thereof was 126° C.

Preparation of Toner 1B

After uniform mixing of 100 parts by weight of Polyurethane Resin 1B prepared in advance, 5 parts by weight of a pigment ("ECR-101", trade name; product of Dainichiseika Color & Chemicals Mfg. Co., Ltd.), 1 part by weight of a release agent ("Purified Carnauba Wax Type #1, trade name; product of Nippon Wax Co., Ltd.) and 3 parts by weight of Charge Control Agent 1B pr pared in advance in a Henschel mixer, the resulting mixture was kneaded in a twin screw extruder. The kneaded product was cooled. The cooled product was roughly pulverized into particles having a diameter of 2 mm. In a ball mill, 100 g of the powder thus obtained and 300 g of ethyl acetate were mixed and dispersed for 12 hours.

The dispersion thus obtained was poured in 2 liter of a 1 mass % of aqueous solution of polyvinyl alcohol, followed by treatment in a homomixer for 5 minutes. The liquid temperature of the resulting mixture was then kept at 70° C. for 6 hours.

After confirmation that the toner particles thus prepared had a volume average particle size of 8 μm, they were cooled gradually to 25° C., followed by the addition of 500 g of 1N dilute hydrochloric acid. The toner particles were taken out from the mixture by suction filtration and washed with pure water in repetition until the filtrate became neutral, followed by drying under reduced pressure. After crushing in an air stream, the crushed particles were sifted through an ultrasonic sieve (opening: 43 μm) to yield toner mother particles.

To 100 parts by weight of the resulting toner mother particles was added 0.5 part by weight of hydrophobic silica ("RX200", trade name; product of Nippon Aerosil Co., Ltd., partial size: 12 nm) and the resulting mixture was stirred in a Henschel mixer, whereby magenta-color Toner 1B was obtained.

The average particle size was indicated by volume distribution D50 as measured by resistance-method particle size analyzer ("Multisizer III", trade name; product of Beckman Coulter, Inc).

Preparation of Toner 2B

In the same manner as that employed for the preparation of Toner 1B except for the use of Charge Control Agent 2B instead of Charge Control Agent 1B, Toner 2B was prepared.

Preparation of Toner 3B

In the same manner as that employed for the preparation of Toner 1B except for the use of Charge Control Agent 3B instead of Charge Control Agent 1B, Toner 3B was prepared.

Preparation of Comparative Toners

In the same manner as those employed for the preparation of Toners 1B to 3B except that Charge Control Agents 1B to 3B were replaced with charge control agents obtained by mixing 1 part by weight of the corresponding Charge Control Agents 1B to 3B and 2 parts by weight of inorganic fine particles without carrying out the adsorption treatment to the inorganic fine particle as described in the preparation of the charge control agent, Comparative Toners 1B to 3B were prepared, respectively.

Evaluation of fog

Each toner to be evaluated for fog was filled in the developing unit of a color laser printer ("LP-3000C", product of Seiko Epson Corp.) serving as an image forming apparatus, and printing was performed only with white (solid white). During printing, the printer was stopped and the photoreceptor was taken out. An adhesive tape ("Scotch Mending Tape", product of Sumitomo 3M) was adhered to a point at which the photoreceptor was brought into contact with a transfer medium, that is, a point at which a transfer nip, a developing roller and the photoreceptor come close each other, that is, a region of a development nip to stick the fog-causing toner to the tape. The resulting tape was adhered to high quality paper for PPC ("Paper J", product of Fuji Xerox Office Supply). As well as the adhesive tape for measuring fog, another adhesive tape without treatment was adhered directly to the high quality paper. Their colors were measured by a chromameter ("CR-221", product of Minolta Camera, Co., Ltd.). The results are shown in Table 1B.

Evaluation of Transfer Property

As in the evaluation of the fog, a solid image was formed so that the deposition amount of the toner onto the photoreceptor would be 0.4 mg/cm. After the transfer of this image to the transfer medium, the printer was terminated and the photoreceptor was taken out. Downstream of the transfer nip, a mending tape was adhered to cause the transfer toner residue to stick thereto. The mending tape was adhered to the above-described paper J and a color difference between the tape and reference value was measured. The smaller the color difference, the better the transfer property.

Filming of Photoreceptor

Filming of the photoreceptor was evaluated by an image forming apparatus having a contact electrification contact development apparatus as illustrated in FIG. 1.

Photoreceptor: organic photoreceptor having a diameter of 43 mm and surface speed of 180 mm/s Dark potential: −600V, light potential: −50V, developing bias: −300V Circumferential speed ratio of developing roller and photoreceptor: 1.8

Developing roller: EPDM rubber having a diameter of 18 mm and conductivity of $10^6$ Ω

Voltage applied for transfer to paper: 1900V

After the image was formed on 5000 sheets of paper, a solid image was formed. When filming disturbs complete printing, the filming was evaluated as poor and this result is shown in Table 1B.

After the image was formed on 5000 sheets of paper, the surface of the charging roller was washed with isopropyl alcohol. Then a solid image was formed. A change in the image density equal to or greater than 0.1 was evaluated as poor and that less than 0.1 was evaluated as good and these results are shown in Table 1 as roller stain.

Five thousands sheets of high quality paper for PPC ("Paper J", product of Fuji Xerox Office Supply) were stacked one after another below the position to be measured and an average of the image densities measured at 5 points by a color densitometer ("X-rite 404", trade name; product of X-rite) was designated as an image density.

TABLE 1B

| | Ex. 1B | Ex. 2B | Ex. 3B | Comp. Ex. 1B | Comp. Ex. 2B | Comp. Ex. 3B |
|---|---|---|---|---|---|---|
| Fog | 0.2 | 0.3 | 0.6 | 2.6 | 1.6 | 1.7 |
| Transfer property | 0.4 | 0.1 | 0.1 | 4.8 | 2.0 | 1.9 |
| Filming | Good | Good | Good | Poor | Good | Good |
| Roller stain | Good | Good | Good | Poor | Poor | Poor |

The toner of the second invention has a charge control agent obtained by incorporating a charge control substance in the pores of an inorganic porous substance serving as a carrier. Even if solvent removal is effected by heating or pressure reduction after the particles obtained by pulverizing a mixture of the toner particle forming composition are mixed and dispersed in a solvent immiscible with water, and the resulting dispersion is pulverized into toner particles, the charge control substance is stably retained in the inorganic porous substance so that the charge control agent exists stably. As a result, charge properties are stable, leading to no generation of oppositely charged toner and less generation of fog. Thus, an image with excellent quality can be formed.

This toner is particularly suitable for a cleaner-less system image forming apparatus in which a transfer residue toner on a photoreceptor is recovered by a developing roller.

Preparation of Charge Control Agent 1C

After 100 g of zeolite (volume average diameter: 60 μm, BET specific surface area: 130 m/g) was dispersed in 500 ml of toluene, 50 g of Charge Control Substance 1C (polysaccharide-based charge control substance "NCA", product of Clariant Japan) was added to the dispersion. The resulting mixture was stirred at 50° C. for 2 hours to prepare a suspension. A solid matter was collected by filtration from the suspension, dried, allowed to stand at 120° C. for 3 hours under normal pressure and then crushed in a mill, whereby a powder having a volume average particle size of 80 μm was obtained.

Preparation of Charge Control Agent 2C

After 100 g of silica ("Aerosil 300", product of Nippon Aerosil Co., Ltd., primary particle size: 7 nm) was dispersed in toluene, 50 g of Charge Control Substance 2C (chromium di-t-butylsalicylate, "Bontron E-81", trade name, product of Orient Chemical Industries, Ltd.) was added to the dispersion. The resulting mixture was stirred at 50° C. for 2 hours to prepare a suspension. A solid matter was collected by filtration from the suspension, dried, allowed to stand at 120° C. for 3 hours under normal pressure and then crushed in a mill, whereby a powder having a volume average particle size of 100 μm was obtained.

Preparation of Charge Control Agent 3C

After 100 g of alkali bentonite (volume average particle size of 40 μm, BET specific surface area of 210 $m^2/g$) was dispersed in water, the resulting dispersion was neutralized with sulfuric acid. Charge Control Substance 3C (zinc di-t-butylsalicylate, "Bontron E-84", trade name; product of Orient Chemical Industries, Ltd., 50 g) was added and the mixture was stirred at 60° C. for 2 hours. A solid matter was then collected by filtration from the suspension, washed with pure water, dried, allowed to stand at 60° C. for 3 hours under reduced pressure and then crushed in a mill, whereby a powder having a volume average particle size of 50 μm was obtained.

Preparation of Toner 1C

A monomer mixture of 60 parts by weight of a styrene monomer, 40 parts by weight of butyl acrylate and 8 parts by weight of acrylic acid was added to an aqueous solution containing 1 part by weight of a nonionic emulsifier ("NOIGEN EA170", trade name; product of Daiichi Kogyo Seiyaku Co., Ltd.), 1.5 parts by weight of an anionic emulsifier ("HITENOL N-08", trade name; product of Daiichi Kogyo Seiyaku Co., Ltd.) and 0.5 part by weight of potassium persulfate while stirring.

The reaction mixture was heated at 70° C. for 8 hours to cause polymerization, whereby an emulsion of a copolymer was obtained. The resulting emulsion (184 parts by weight), 2 parts by weight of Charge Control Agent 1C prepared in advance, 5 parts by weight of carbon black ("Regal 330R", trade name; product of Cabot Corporation) and 300 parts by water were dispersed by stirring at 30° C. for 2 hours. The dispersion was stirred for further 3 hours at 70° C.

After confirmation that the toner mother particles thus prepared have a volume average particle size of 8 μm, they were cooled gradually, followed by the addition of 500 g of 1N dilute hydrochloric acid. The toner mother particles were taken out from the mixture by suction filtration, washed with water in repetition until the filtrate became neutral, dried under reduced pressure, and crushed by a jet mill. The crushed particles were sifted through an ultrasonic sieve (opening: 43 μm) to yield a toner.

To 100 parts by weight of the resulting toner mother particles was added 0.5 part by weight of hydrophobic silica ("RX200", trade name; product of Nippon Aerosil Co., Ltd., particle size: 12 nm) and the resulting mixture was stirred in a Henschel mixer, by which black Toner 1C was obtained.

The average particle size was indicated by volume distribution D50 as measured by resistance-method particle size analyzer ("Multisizer III", trade name; product of Beckman Coulter, Inc).

Preparation of Toner 2C

In the same manner as that employed for the preparation of Toner 1C except for the use of Charge Control Agent 2C instead of Charge Control Agent 1C, Toner 2C was prepared.

Preparation of Toner 3C

In the same manner as that employed for the preparation of Toner 1C except for the use of Charge Control Agent 3C instead of Charge Control Agent 1C, Toner 3C was prepared.

Preparation of Comparative Toner

In the same manner as those employed for the preparation of Toners 1A to 3A except that Charge Control Agents 1A to 3A were replaced with charge control agents obtained by mixing 1 part by weight of the corresponding Charge Control Agents 1A to 3A and 2 parts by weight of inorganic fine particles without carrying out the adsorption treatment to the inorganic fine particle as described in the preparation of the charge control agent, Comparative Toners 1A to 3A were prepared, respectively.

Evaluation of Fog

Each toner to be evaluated for fog was filled in the developing unit of "Color Laser Printer ("LP-3000C", product of Seiko Epson Corp.) serving as an image forming apparatus, and printing was performed only with white (solid white). During printing, the printer was stopped and the photoreceptor was taken out. An adhesive tape ("Scotch Mending Tape", product of Sumitomo 3M) was adhered to a point at which the photoreceptor was brought into contact with a transfer medium, that is, a point at which a transfer nip, a developing roller and the photoreceptor come close each other, that is, a region of a development nip to stick the fog-causing toner to the tape. The resulting tape was adhered to high quality paper for PPC ("Paper J", product of Fuji Xerox Office Supply).

As well as the adhesive tape for measuring fog, another adhesive tape without treatment was adhered directly to the high quality paper for PPC. Their colors were measured by a chromameter ("CR-221", product of Minolta Camera, Co., Ltd.). The results are shown in Table 1C.

Evaluation of Transfer Property

As in the evaluation of the fog, a solid-image was formed so that the adhesion amount of the toner onto the photoreceptor would be 0.4 mg/cm. After the transfer of this image to the transfer medium from the photoreceptor, the printer was terminated and the photoreceptor was taken out. Downstream of the transfer nip, a mending tape was adhered to transfer the transfer toner residue thereto. The mending tape was applied to high quality paper for PPC and a color difference between the tape and reference value was measured.

Evaluation of Cleaner-Less Durability

Durability was evaluated by an image forming apparatus having a contact electrification contact development apparatus as illustrated in FIG. 1.

Photoreceptor: organic photoreceptor having a diameter of 43 mm and surface speed of 180 mm/s Dark potential: −600V, light potential: −50V, development bias: −300V Circumferential speed ratio of developing roller and photoreceptor: 1.8

Developing roller: EPDM rubber having a diameter of 18 mm and conductivity of $10^4$ Ω

Voltage applied for transfer to paper: 1900V

After the image was formed on 5000 sheets of paper, the surface of a charge roller was washed with isopropyl alcohol. Then a solid image was formed. A change in the image density equal to or greater than 0.1 was evaluated as poor and that less than 0.1 was evaluated as good and these results are shown in Table 1C as roller stain.

Five thousands sheets of high quality paper for PPC ("Paper J", product of Fuji Xerox Office Supply) were stacked one after another below the position to be measured and an average of the image densities measured at 5 points by a color densitometer ("X-rite 404", trade name; product of X-rite) was designated as an image density.

TABLE 1C

| | Ex. 1C | Ex. 2C | Ex. 3C | Comp. Ex. 1C | Comp. Ex. 2C | Comp. Ex. 3C |
|---|---|---|---|---|---|---|
| Fog | 0.3 | 0.2 | 0.7 | 3.4 | 4.2 | 2.6 |
| Transfer property | 0.4 | 0.4 | 0.3 | 4.5 | 2.3 | 1.7 |
| Filming | Good | Good | Good | Poor | Poor | Poor |
| Roller stain | Good | Good | Good | Poor | Poor | Poor |

In the toner of the third invention, toner mother particles comprising the associated secondary particles are prepared by adding a colorant and a charge control agent comprising a water soluble charge control substance incorporated in inorganic fine particles to an emulsion of a binder resin and heating the mixture. The mother particles therefore have a high sphericity. Even in an aqueous medium, the charge control agent is stably retained so that elution thereof in the medium can be prevented. Even if the aqueous medium is separated by heating or pressure reduction after the formation of toner mother particles, the charge control agent exhibits stable existence in the toner mother particles without being lost much by sublimation or oxidative decomposition. Since the charge property is stable, no reverse charge toner appears and fog occurs less, making it possible to form images with high quality. In particular, the toner of the present invention is suitable for a cleaner-less image forming apparatus which recovers a transfer residue toner remaining on a photoreceptor by a developing roller.

While the present invention has been described in detail and with reference to specific embodiments thereof, it will be apparent to one skilled in the art that various changes and modifications can be made therein without departing the spirit and scope thereof.

This application is based on Japanese Patent Application Nos. 2002-324779 (filed Nov. 8, 2002), 2002-338561 (filed Nov. 21, 2002) and 2002-338565 (filed Nov. 21, 2002), the contents thereof being herein incorporated by reference.

What is claimed is:

1. A toner comprising associated particles formed from a composition comprising:

primary particles obtained from an emulsion of a binder resin;

a colorant; and a charge control agent comprising a water soluble charge control substance incorporated in inorganic fine particles.

2. The toner of claim 1, wherein said inorganic particles comprise an inorganic porous material.

3. A developing unit for use in an image forming apparatus which develops an electrostatic latent image formed on a photoreceptor, transfers the image onto a recording medium, and then fixes the transferred image, said developing unit comprising:

a developing roller which supplies a toner onto the photoreceptor to develop the electrostatic latent image, and a bias voltage applying member which applies a bias voltage to said developing roller to recover a toner remaining on the photoreceptor after the transfer step, wherein said toner comprises associated particles formed from a composition comprising:

primary particles obtained from an emulsion of a binder resin;

a colorant; and a charge control agent comprising a water soluble charge control substance incorporated in inorganic fine particles.

* * * * *